US011145992B2

(12) United States Patent
Kim et al.

(10) Patent No.: US 11,145,992 B2
(45) Date of Patent: Oct. 12, 2021

(54) ANTENNA STRUCTURE HAVING PLURAL SLITS ARRANGED AT PREDETERMINED INTERVAL ON CONDUCTIVE SUBSTRATE AND ANOTHER SLIT EXTENDING TO SPACE BETWEEN SLITS, AND ELECTRONIC DEVICE INCLUDING ANTENNA STRUCTURE

(71) Applicants: Samsung Electronics Co., Ltd., Suwon-si (KR); INDUSTRY-ACADEMIC COOPERATION FOUNDATION, YONSEI UNIVERSITY, Seoul (KR)

(72) Inventors: Sungsoo Kim, Suwon-si (KR); Youngjoong Yoon, Seoul (KR); Sunghoe Kim, Seoul (KR); Janghwan Bae, Seoul (KR)

(73) Assignees: Samsung Electronics Co., Ltd., Suwon-si (KR); INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 94 days.

(21) Appl. No.: 16/504,037

(22) Filed: Jul. 5, 2019

(65) Prior Publication Data

US 2020/0014119 A1 Jan. 9, 2020

(30) Foreign Application Priority Data

Jul. 6, 2018 (KR) ..... 10-2018-0079015

(51) Int. Cl.
*H01Q 21/06* (2006.01)
*H01Q 21/00* (2006.01)
(Continued)

(52) U.S. Cl.
CPC ..... *H01Q 21/064* (2013.01); *H01Q 1/22* (2013.01); *H01Q 1/243* (2013.01); *H01Q 1/44* (2013.01);
(Continued)

(58) Field of Classification Search
CPC .... H01Q 21/064; H01Q 21/0025; H01Q 1/22; H01Q 1/523; H01Q 21/24; H01Q 1/44;
(Continued)

(56) References Cited

U.S. PATENT DOCUMENTS

2002/0030627 A1 3/2002 Cassel
2003/0184477 A1* 10/2003 Shafai ..... H01Q 21/065 343/700 MS
(Continued)

FOREIGN PATENT DOCUMENTS

CN 107275760 A 10/2017
EP 3 331 096 A 6/2018
(Continued)

OTHER PUBLICATIONS

International Search Report and Written Opinion dated Oct. 15, 2019, issued in International Patent Application No. PCT/KR2019/008320.
(Continued)

*Primary Examiner* — Hai V Tran
(74) *Attorney, Agent, or Firm* — Jefferson IP Law, LLP

(57) ABSTRACT

Various embodiments disclosed herein relate to an antenna device that provides a wireless communication function and an electronic device including the antenna device is provided. The electronic device includes a communication module and an antenna structure electrically connected to the communication module. The antenna structure may include a conductive substrate including a first area and a second area adjacent to the first area a plurality of first slits
(Continued)

formed in the first area of the conductive substrate parallel to each other with a first predetermined interval therebetween in a predetermined direction and a plurality of second slits formed in the second area of the conductive substrate at a position corresponding to an inter-slit area between at least some slits among the plurality of first slits.

21 Claims, 16 Drawing Sheets
(4 of 16 Drawing Sheet(s) Filed in Color)

(51) Int. Cl.

| | |
|---|---|
| ***H01Q 1/52*** | (2006.01) |
| ***H01Q 1/22*** | (2006.01) |
| ***H01Q 21/24*** | (2006.01) |
| ***H01Q 1/44*** | (2006.01) |
| ***H01Q 1/24*** | (2006.01) |

(52) U.S. Cl.
CPC ..... *H01Q 1/52* (2013.01); *H01Q 1/523* (2013.01); *H01Q 21/00* (2013.01); *H01Q 21/0025* (2013.01); *H01Q 21/06* (2013.01); *H01Q 21/24* (2013.01)

(58) Field of Classification Search
CPC ..... H01Q 1/243; H01Q 21/06; H01Q 1/53; H01Q 21/00
USPC ..... 343/720
See application file for complete search history.

(56) References Cited

U.S. PATENT DOCUMENTS

| | | | | |
|---|---|---|---|---|
| 2006/0028387 | A1 | 2/2006 | Kuo et al. | |
| 2009/0322621 | A1 | 12/2009 | Inanoglu et al. | |
| 2014/0218250 | A1 | 8/2014 | Kim et al. | |
| 2014/0266922 | A1* | 9/2014 | Jin | H01Q 5/314 343/702 |
| 2016/0049734 | A1* | 2/2016 | Kim | H01Q 21/28 343/702 |
| 2017/0294705 | A1 | 10/2017 | Khripkov et al. | |
| 2018/0069293 | A1* | 3/2018 | Hu | H01Q 1/44 |
| 2018/0076529 | A1 | 3/2018 | Minard et al. | |
| 2021/0111484 | A1* | 4/2021 | Jang | H01Q 1/42 |

FOREIGN PATENT DOCUMENTS

| | | | |
|---|---|---|---|
| KR | 10-2011-0027824 | A | 3/2011 |
| KR | 10-2014-0020670 | A | 2/2014 |
| KR | 10-2018-0060299 | A | 6/2018 |
| WO | 02/35652 | A1 | 5/2002 |

OTHER PUBLICATIONS

Counterpart European Search Report dated Jul. 16, 2021, issued in European Patent Application No. 19830932.0.

* cited by examiner (a) (b) (c)

ANTENNA STRUCTURE HAVING PLURAL SLITS ARRANGED AT PREDETERMINED INTERVAL ON CONDUCTIVE SUBSTRATE AND ANOTHER SLIT EXTENDING TO SPACE BETWEEN SLITS, AND ELECTRONIC DEVICE INCLUDING ANTENNA STRUCTURE

CROSS-REFERENCE TO RELATED APPLICATION(S)

This application is based on and claims priority under 35 U.S.C. § 119(a) of a Korean patent application number 10-2018-0079015, filed on Jul. 6, 2018, in the Korean Intellectual Property Office, the disclosure of which is incorporated by reference in its entirety.

JOINT RESEARCH AGREEMENT

The disclosure was made by or on behalf of the below listed parties to a joint research agreement. The joint research agreement was in effect on or before the date the disclosure was made and the disclosure was made as a result of activities undertaken within the scope of the joint research agreement. The parties to the joint research agreement are 1) SAMSUNG ELECTRONICS CO., LTD. and 2) INDUSTRY-ACADEMIC COOPERATION FOUNDATION, YONSEI UNIVERSITY

BACKGROUND

1. Field

The disclosure relates to an antenna device that provides a wireless communication function and an electronic device including the antenna device.

2. Description of Related Art

In order to provide a service of stabilized quality in a commercialized wireless communication network, a high gain and a wide radiation area (beam coverage) of an antenna device should be satisfied. Next generation mobile communication services (e.g., 5th generation (5G) communication) having a frequency band of several tens of gigahertz (GHz) or more (e.g., a frequency band in the range of 30 to 300 GHz and a resonant frequency wavelength in the range of approximately 1 to 10 mm) are capable of providing a wireless communication network improved in connection scalability to electronic devices and providing faster and more stable communication quality to users by implementing improved ease of connection (e.g., wireless connectivity) with nearby electronic devices and improved energy efficiency.

The above information is presented as background information only to assist with an understanding of the disclosure. No determination has been made, and no assertion is made, as to whether any of the above might be applicable as prior art with regard to the disclosure.

SUMMARY

An antenna device used for wireless communication may be manufactured after optimizing the operation characteristic of the antenna device through various simulations in the process of developing the antenna device. However, even if the operational characteristics of the antenna device are optimized, the operational characteristics may be distorted when the antenna device is mounted on the electronic device. In other words, the operational characteristics of the antenna device may be variously changed depending on a specification of the electronic device or a mounting environment of the manufactured antenna device.

Since an antenna device used for (5th generation) 5G communication (or millimeter wave (mmWave) communication) has a resonant frequency wavelength of only about 1 to 10 mm, the rectilinearity and directivity are high, so that the radiation performance of the antenna device may be significantly distorted depending on the installation environment thereof. For example, when a manufactured mmWave communication antenna device is mounted on an electronic device or the like, the performance of the antenna device may be deteriorated due to interference with a peripheral structure or the like of the electronic device or a part of the user's body.

Accordingly, in the case where an antenna device is mounted on an electronic device but fails to exhibit optimized operational characteristics, it may take considerable time and expense to develop and manufacture the antenna device from the initial simulation stage to the practical production of the electronic device including, for example, re-development of the antenna.

According to some embodiments, control of the antenna beam radiation range of the antenna device (steering range control) may be performed using a processor and a communication module mounted within an electronic device, but it is merely one-dimensional control. In addition, it may be difficult to exhibit optimized operational characteristics of the antenna device since the material of the electronic device, for example, the design of a bezel made of a metal material, is not considered.

Aspects of the disclosure are to address at least the above-mentioned problems and/or disadvantages and to provide at least the advantages described below. Accordingly, an aspect of the disclosure is to provide an antenna structure that is capable of preventing the distortion of radiation performance due to the installation environment thereof and interference with surroundings thereby providing a stable wireless communication function and an electronic device including the antenna structure.

Another aspect of the disclosure is to provide an antenna structure that is capable of securing stable radiation performance in the millimeter wave (mmWave) frequency band, and an electronic device including the antenna structure.

Additional aspects will be set forth in part in the description which follows and, in part, will be apparent from the description, or may be learned by practice of the presented embodiments.

In accordance with an aspect of the disclosure, an electronic device is provided. The electronic device includes a communication module and an antenna structure electrically connected to the communication module. The antenna structure may include a conductive substrate including a first area and a second area adjacent to the first area, a plurality of first slits formed in the first area of the conductive substrate parallel to each other with a first predetermined interval therebetween in a predetermined direction, and a plurality of second slits formed in the second area of the conductive substrate at a position corresponding to an inter-slit area between at least some slits among the plurality of first slits. The plurality of second slits may be disposed parallel to each other at a second predetermined interval therebetween in the predetermined direction, and the plurality of second slits may be configured to extend to a portion of the inter-slit area.

In accordance with another aspect of the disclosure, an electronic device is provided. The electronic device includes a communication module, and an antenna structure electrically connected to the communication module. The antenna structure may include a conductive substrate including a first area and a second area adjacent to the first area, a plurality of slits formed in the first area of the conductive substrate parallel to each other with a first predetermined interval therebetween in a predetermined direction; and one or more slits formed in the second area of the conductive substrate at a position corresponding to an inter-slit area between at least some slits among the plurality of first slits. The one or more slits may be disposed parallel to each other in the predetermined direction, and the plurality of second slits may be configured to extend to a portion of the inter-slit area.

In accordance with another aspect of the disclosure, an electronic device is provided. The electronic device includes a housing having a space formed therein to accommodate at least one electronic component therein, and at least one antenna structure disposed in at least a part of the housing. The at least one antenna structure may include a plate that surrounds an inner space of the electronic device, the plate having a first face facing an outside of the electronic device, at least one of a first extension integrally extending from the plate and having a second face, at least a portion of which is oriented in a direction different from a direction in which the first face is oriented, or a second extension integrally extending from the plate and having a third face, at least a portion of which is oriented in a direction different from the direction in which the first face is oriented, and a plurality of slits formed in at least a part of the plate and at least a part of the first extension or in at least a part of the plate and at least a part of the second extension parallel to each other with a predetermined interval therebetween.

According to various embodiments, a plurality of conductive lines may be disposed on the rear face of the conductive substrate having the plurality of slits formed therein.

According to various embodiments disclosed herein, it is possible to secure a stable radiation performance in an antenna structure and an electronic device including the antenna structure by setting the antenna structure located in at least a part of the housing as a millimeter wave communication antenna. For example, by controlling the radiation range of antenna beams using a plurality of slits separately disposed in at least two areas of the antenna structure, it is possible to prevent a radiation performance from being distorted due to interference by a peripheral structure of the electronic device or a part of the user's body.

In accordance with another aspect of the disclosure, an antenna device and/or an electronic device are provided. The antenna device and/or the electronic device include the antenna device according to various embodiments of the disclosure, since a plurality of conductive lines are disposed adjacent to each other on the rear face of the conductive substrate in which the plurality of slits are formed, a resonant frequency can be easily adjusted.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
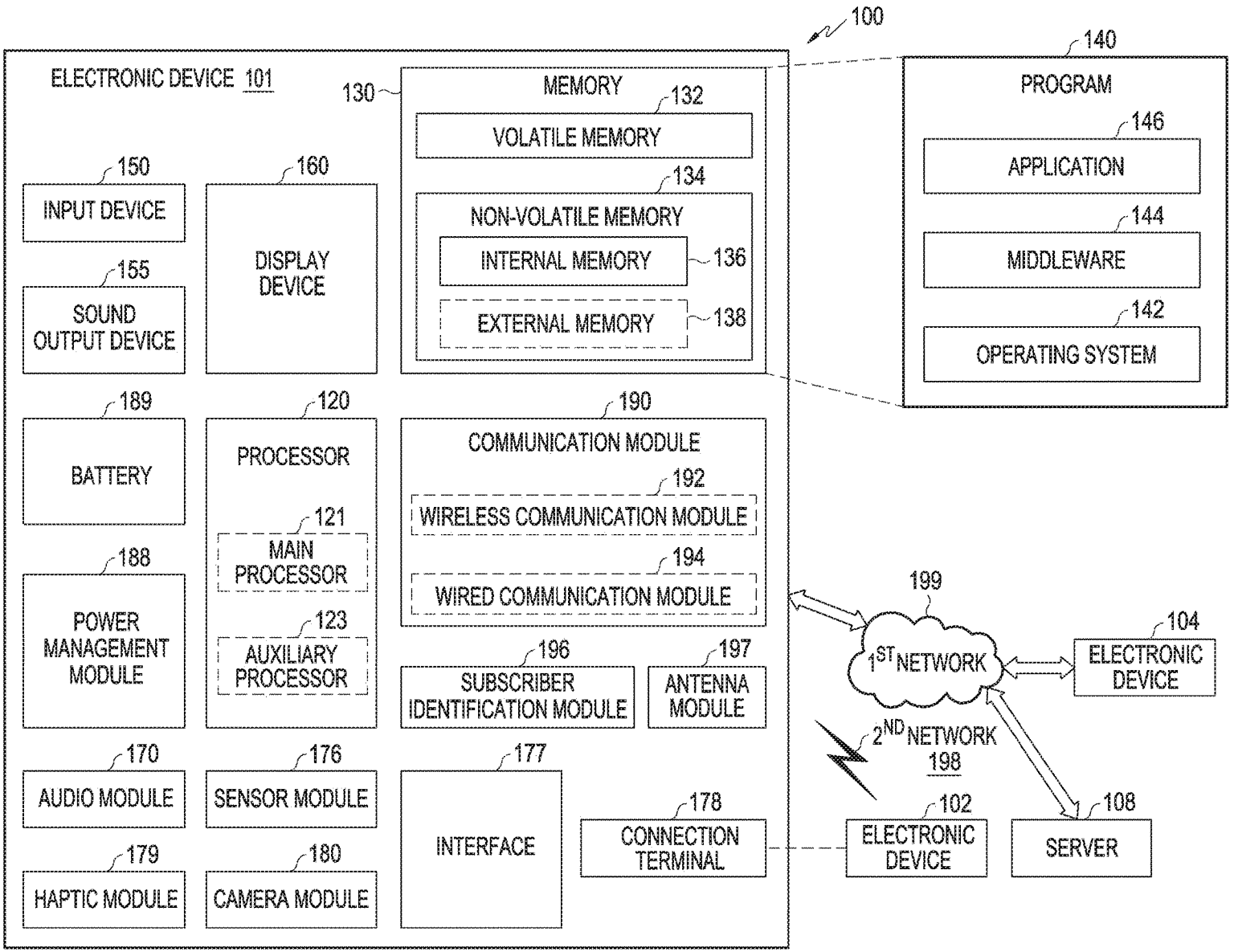
FIG. 1 is a block diagram of an electronic device in a network environment according to an embodiment of the disclosure.

FIG. 1 is a block diagram illustrating an electronic device 101 in a network environment 100 according to an embodiment the disclosure.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an ISP or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture an image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ Wi-Fi direct, or IR data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
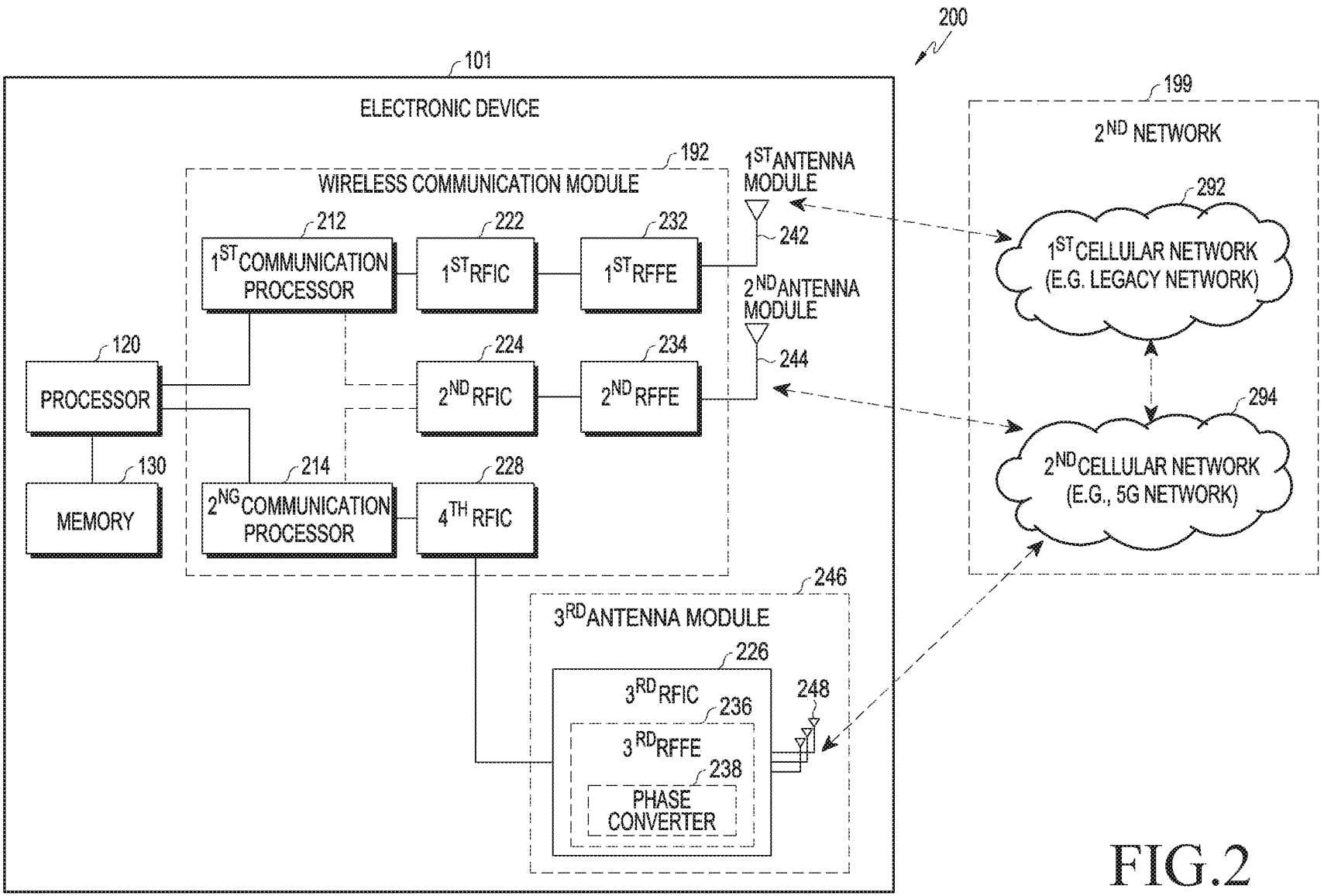
FIG. 2 is a block diagram of an electronic device in a network environment including a plurality of cellular networks according to an embodiment of the disclosure.

FIG. 2 is a block diagram (200) of an electronic device 101 according to various embodiments in a network environment including a plurality of cellular networks according to an embodiment of the disclosure.

Referring to FIG. 2, an electronic device 101 may include a first CP 212, a second CP 214, a first RFIC 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include a processor 120 and memory 130. A second network 199 may include a first cellular network 292 and a second cellular network 294. According to another embodiment, the electronic device 101 may further include at least one of the components illustrated in FIG. 1, and the second network 199 may further include at least one other network. According to an embodiment, the first CP 212, the second CP 214, the first RFIC 222, the second RFIC 224, the fourth RFIC 228, the first RFFE 232, and the second RFFE 234 may form at least a part of the wireless communication module 192. According to another embodiment, the fourth RFIC 228 may be omitted or included as a part of the third RFIC 226.

The first CP 212 may establish a communication channel of a band to be used for wireless communication with the first cellular network 292, and may support legacy network communication through the established communication channel According to various embodiments, the first cellular network may be a legacy network including a 2nd generation (2G), 3rd generation (3G), 4th generation (4G), or long-term evolution (LTE) network. The second CP 214 may establish a communication channel corresponding to a designated band (e.g., about 6 GHz to about 60 GHz) of the band to be used for wireless communication with the second cellular network 294, and may support 5G network communication through the established communication channel According to various embodiments, the second cellular network 294 may be a 5G network as defined in the $3^{rd}$ generation partnership project (3GPP). Additionally, according to an embodiment, the first CP 212 or the second CP 214 may establish a communication channel corresponding to another designated band (e.g., about 6 GHz or lower) in the band to be used for wireless communication with the second communication network 294, and may support 5G network communication through the established communication channel According to an embodiment, the first CP 212 and the second CP 214 may be implemented in a single chip or in a single package. According to various embodiments, the first CP 212 or the second CP 214 may be formed in a single chip or a single package with the processor 120, an auxiliary processor 123, or a communication module 190.

During transmission, the first RFIC 222 may convert a baseband signal generated by the first CP 212 to a radio frequency (RF) signal of about 700 MHz to about 3 GHz used in the first cellular network 292 (e.g., a legacy network). During reception, an RF signal may be acquired from the first cellular network S92 (e.g., the legacy network) through an antenna (e.g., the first antenna module 242), and may be pre-processed through an RFFE (e.g., the first RFFE 232). The first RFIC 222 may convert the pre-processed RF signal to a baseband signal for processing by the first CP 212.

During transmission, the second RFIC 224 may convert the baseband signal generated by the first CP 212 or the second CP 214 into an RF signal in a Sub6 band (e.g., about 6 GHz or lower) (hereinafter, referred to as a 5G sub6 RF signal) used in the second cellular network S94 (e.g., a 5G network). During reception, the 5G Sub6 RF signal is acquired from the second cellular network 294 (e.g., a 5G network) through an antenna (e.g., the second antenna module 244*a*), and may be pre-processed through an RFFE (e.g., the second antenna module 244). The second RFIC 224 may convert the pre-processed 5G Sub6 RF signal into a baseband signal to be processed by a corresponding one of the first CP 212 and the second CP 214.

The third RFIC 226 may convert the baseband signal generated by the second CP 214 into an RF signal (hereinafter, referred to as a "5G Above6 RF signal") of a 5G Above6 band (e.g., about 6 GHz to about 60 GHz) to be used in the second cellular network 294 (e.g., a 5G network). During reception, the 5G Above6 RF signal may be obtained from the second cellular network 294 (e.g., a 5G network) through an antenna (e.g., the antenna 248), and may be pre-processed through the third RFFE 236. The third RFIC 2 26 may convert the pre-processed 5G Above6 RF signal into a baseband signal so that the baseband signal can be processed by the second CP 214. According to an embodiment, the third RFFE 236 may be formed as a part of the third RFIC 226.

According to an embodiment, the electronic device 101 may include a fourth RFIC 228, separately from or as at least a part of the third RFIC 226. In this case, the fourth RFIC 228 may convert a baseband signal generated by the second CP 214 into an RF signal (hereinafter referred to as an "IF signal") in an intermediate frequency band (e.g., about 9 GHz to about 11 GHz) and may then deliver the IF signal to the third RFIC 226. The third RFIC 226 may convert the IF signal into a 5G Above6 RF signal. During reception, the 5G Above6 RF signal may be received from the second cellular network 294 (e.g., a 5G network) through an antenna (e.g., the antenna 248), and may be converted into an IF signal by the third RFIC 226. The fourth RFIC 228 may convert the IF signal to a baseband signal such that the baseband signal can be processed by the second CP 214.

According to an embodiment, the first RFIC 222 and the second RFIC 224 may be implemented as at least a part of a single chip or a single package. According to an embodiment, the first RFFE 232 and the second RFFE 234 may be implemented as at least a part of a single chip or a single package. According to an embodiment, at least one of the first antenna module 242 and the second antenna module 244 may be omitted or combined with other antenna modules so as to process RF signals of a plurality of corresponding bands.

According to an embodiment, the third RFIC 226 and the antenna 248 may be placed on the same substrate so as to form a third antenna module 246. For example, the wireless communication module 192 or the processor 120 may be placed on a first substrate (e.g., a main PCB). In such a case, the third RFIC 226 may be disposed on a partial area (e.g., a lower face) of a second substrate (e.g., a sub-PCB) separate from the first substrate, and the antenna 248 may be disposed on another partial area (e.g., an upper face) and some areas, thereby forming the antenna module 246. By disposing the third RFIC 226 and the antenna 248 on the same substrate, it is possible to reduce the length of the transmission line therebetween. Through this, it is possible to reduce the loss (e.g., attenuation) of a signal in a high frequency band (e.g., about 6 GHz to about 60 GHz) used for, for example, 5G network communication by the transmission line. As a result, the electronic device 101 is able to improve the quality or speed of communication with the second cellular network 294 (e.g., a 5G network).

According to an embodiment, the antenna 248 may be formed as an antenna array that includes a plurality of antenna elements that can be used for beamforming. In this case, the third RFIC 226 may include a plurality of phase shifters 238 corresponding to a plurality of antenna elements, for example, as part of the third RFFE 236. During transmission, each of the plurality of phase shifters 38 may convert the phase of a 5G Above6 RF signal to be transmitted to the outside of the electronic device (e.g., the base station of a 5G network) through the corresponding antenna element. During reception, each of the plurality of phase shifters 238 may convert the phase of the 5G Above6 RF signal received from the outside into the same or substantially the same phase through the corresponding antenna element. This enables transmission or reception through beamforming between the electronic device 101 and the outside.

The second cellular network 294 (e.g., a 5G network) may be operated independently from the first cellular network 292 (e.g., a legacy network) (e.g., stand-alone (SA)), or may be operated in the state of being connected to the first cellular network 292 (non-stand alone (NSA)). For example, a 5G network may have only an access network (e.g., a 5G radio access network (RAN) or a next generation RAN (NG RAN)), and a core network (e.g., a next generation core (NGC)) may not exist in the 5G network. In this case, after accessing the access network of the 5G network, the electronic device 101 may access the external network (e.g., the Internet) under the control of the core network (e.g., an evolved packed core (EPC)) of a legacy network. Protocol information for communication with a legacy network (e.g., LTE protocol information) or protocol information for communication with a 5G network (e.g., new radio (NR) protocol information) is stored in the memory 230, and may be accessed by another component (e.g., the processor 120, the first CP 212, or the second CP 214).

Figure 3:
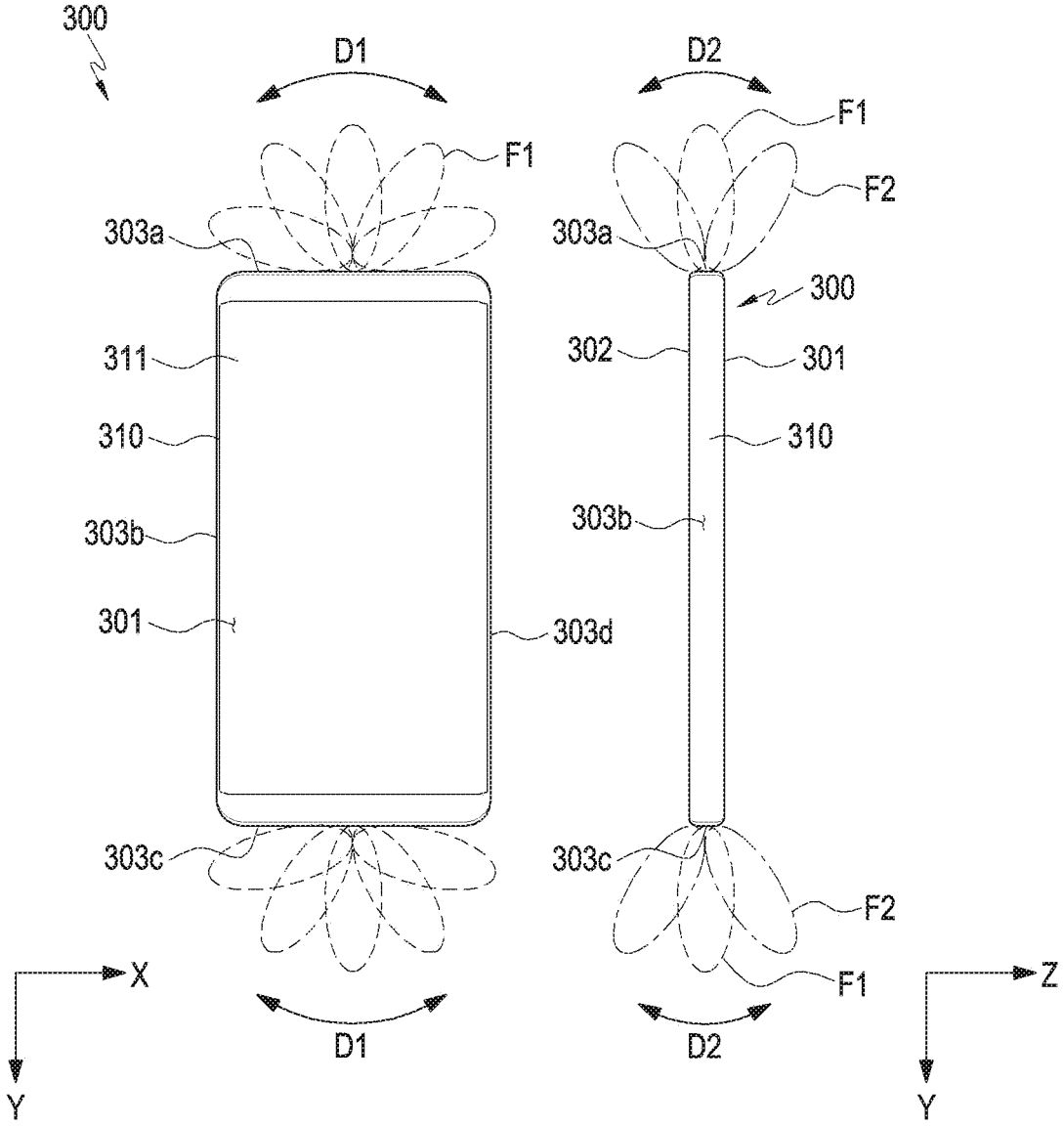
FIG. 3 represents the range in which antenna beams are radiated (the beam steering range) from an electronic device according to an embodiment of the disclosure.

FIG. 3 represents the range in which antenna beams are radiated (the beam steering range) from an electronic device 300 according to an embodiment of the disclosure.

Figure 4:
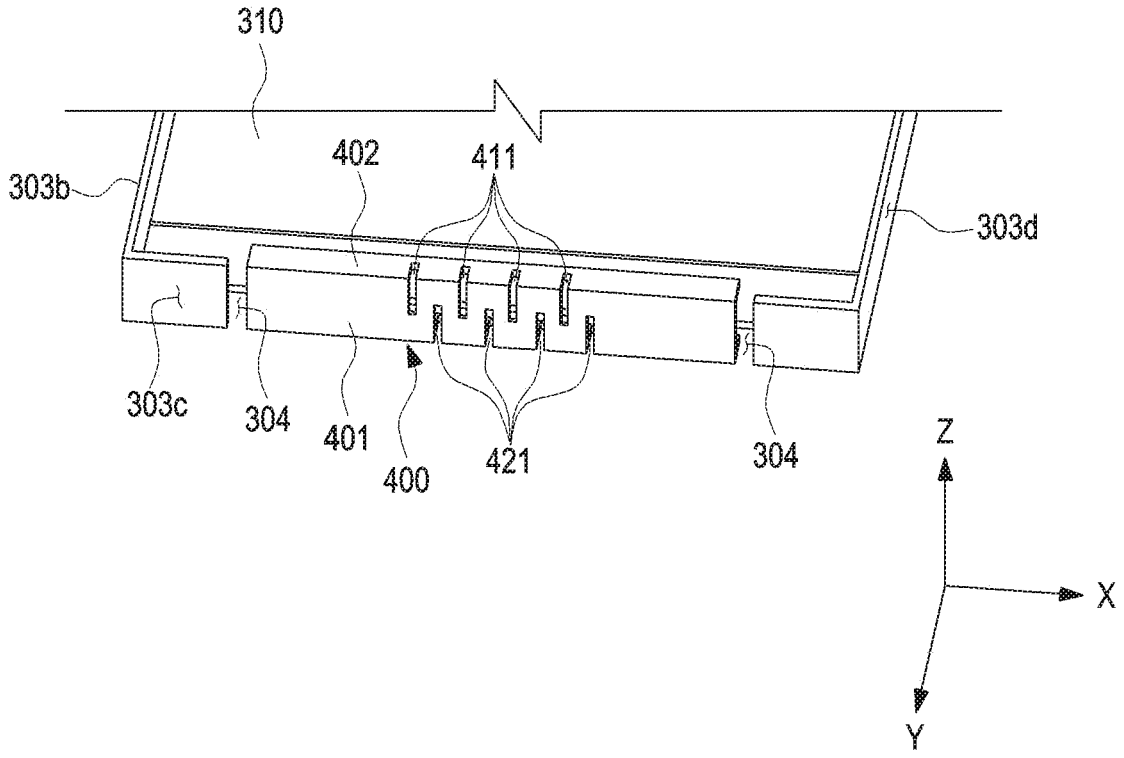
FIG. 4 is a perspective view briefly illustrating a housing and an antenna structure of an electronic device according to an embodiment of the disclosure.

FIG. 4 is a perspective view briefly illustrating a housing 310 and an antenna structure 400 of an electronic device (the electronic device 101 in FIG. 1) according to an embodiment of the disclosure.

FIG. 3 includes a view in which the front face 301 of the electronic device 300 is shown, and a view in which one side face 303*b* of the electronic device 300 is shown.

Referring to FIG. 3, the electronic device 300 includes a housing 310, and further includes at least one processor (e.g., the processor 120 in FIG. 1) and a communication module (e.g., the communication module 190 in FIG. 1) in the housing 310. In addition, an electronic device (e.g., the electronic device 101 of FIG. 1) may include an antenna structure 400 electrically connected to the communication module.

According to an embodiment, the housing 310 is capable of protecting the other components of the electronic device 300. The housing 310 may include, for example, a front plate disposed on the front face 301 of the electronic device 300, a rear plate disposed on the rear face 302 facing away from the front face 301, and a side member attached to the rear plate or integrally formed with the rear plate and surrounding the space between the front plate and the rear plate. Here, the side member may be formed on the side surfaces 303*a*, 303*b*, 303*c*, and 303*d* oriented in directions different from those of the front face 301 and the rear face 302. According to an embodiment, the front face 301 of the electronic device 300 may be mounted with a display 311 that is visible through a large portion of the front plate.

According to various embodiments, coordinate axes shown in the drawings of this document are for indicating the directions in which certain components are oriented. Here, the coordinate axes may be coordinate axes (X axis, Y axis, and Z axis) in the three-dimensional space. Referring to FIGS. 3 and 4, the X axis may be an axis parallel to the width direction of the electronic device 300 (or the width direction of the antenna structure 400 in FIG. 4), and the Y axis may be an axis parallel to the length direction of the electronic device 300 (or the thickness direction of the antenna structure 400 in FIG. 4). In addition, the Z axis may be an axis parallel to the thickness direction of the electronic device 300 (or the height direction of the antenna structure 400 in FIG. 4). According to an embodiment, the XY plane may be a plane parallel to the horizontal plane of the electronic device, and the YZ plane may be a plane parallel to the vertical plane of the electronic device.

FIG. 3 simply illustrates the case in which antenna structures (the antenna structure 400 in FIG. 4) are disposed in the center of the upper end portion and in the center portion of the lower end portion of the electronic device 300 to radiate antenna beams for convenience of explanation. However, the disclosure is not necessarily limited thereto, and antenna structures (the antenna structure 400 in FIG. 4) may be disposed at various positions unlike what is illustrated in the drawings.

Referring to FIGS. 3 and 4, the antenna structure 400 of FIG. 4 may form a first steering range of the antenna beams F1 (dashed lines) on the horizontal plane of the electronic device 300. Unless otherwise specified, the first steering range of the antenna beams on the horizontal plane may cover substantially the entire area of the horizontal plane of the electronic device 300 in a direction D1. In addition, the antenna structures (the antenna structure 400 in FIG. 4) according to various embodiments disclosed herein are not limited to the above-described one-dimensional area (horizontal plane area), and may also have a second steering range of antenna beams F2 (one-dot chain lines) on the vertical plane of the electronic device 300. Unless otherwise specified, the second steering range of the antenna beams on the vertical plane may cover substantially the entire area of the vertical plane of the electronic device 300 in a direction D2.

According to various embodiments, a processor (e.g., the processor 120 in FIG. 1) disposed inside the housing 310 may include one or more of a central processing unit, an application processor, a GPU, a camera image signal processor, or a baseband processor (or a CP). According to an embodiment, the processor (e.g., the processor 120 in FIG. 1) may be implemented as a system on chip (SoC) or a system in package (SiP). The communication module (e.g., the communication module 190 in FIG. 1) may include, for example, a baseband processor, or at least one communication circuit (e.g., an IFIC, or an RFIC). The communication module (e.g., the communication module 190 in FIG. 1) may include, for example, a baseband processor separate from a processor (e.g., the processor 120 in FIG. 1) (e.g., an AP). In this case, the baseband processor of the communication module (e.g., the communication module 190 in FIG. 1) may be disposed within a single chip together with a processor (e.g., the processor 120 in FIG. 1) or in the form of an independent chip.

According to various embodiments, it is possible to deal with a first network (e.g., the first network 198 in FIG. 1) for short-range communication and a second network (e.g., the second network 199 in FIG. 1) for long-range communication via the processor (e.g., the processor 120 in FIG. 1) and the communication module (e.g., the communication module 199 in FIG. 1). According to an embodiment, it is possible to deal with a first cellular network (e.g., the first network 292 in FIG. 2) and a second cellular network (e.g., the second network 294 in FIG. 2) included in the second network (e.g., 199 in FIG. 1) via the processor (e.g., the processor 120 in FIG. 1) and the communication module (e.g., the communication module 190 in FIG. 1). Each of the first cellular network (e.g., the first cellular network 292 in FIG. 2) and the second cellular network (e.g., the second cellular network 294 in FIG. 2) may include a 4G network and a 5G network. Here, the 4G network may support the long term evolution (LTE) protocol defined in, for example, the 3GPP. The 5G network may support, for example, the new radio (NR) protocol defined in the 3GPP.

According to various embodiments, the electronic device 300 may include a plurality of antenna modules (e.g., the third antenna module 246 in FIG. 2) according to various embodiments. The plurality of antenna modules may be disposed at a position very close to the housing 310 inside the electronic device 300. By disposing one or more antenna modules at a position very close to the housing 310, it is possible to reduce propagation path loss when at least a part of the housing is used as an antenna element (e.g., the antenna element 248 of FIG. 2).

For example, according to an embodiment in which four antenna modules (e.g., the third antenna module 246 in FIG. 2) are provided, when viewed from above the front plate of the electronic device, one antenna module (e.g., a 3-1 antenna module (not illustrated)) may be disposed in the upper end of the electronic device 300 adjacent to the first side face 303*a*, and another antenna module (e.g., a 3-2 antenna module (not illustrated)) may be disposed on the left side of the electronic device 300 adjacent to the second side face 303*b*, and another antenna module (e.g., a 3-3 antenna module (not illustrated) may be disposed in the lower end of the electronic device 300 adjacent to the third side face 303*c*. In addition, another remaining antenna module (e.g., a 3-4 antenna module (not illustrated)) may be disposed on the right side of the electronic device 300 adjacent to the fourth side face 303*d*. This is merely an example, and various other arrangements may be possible.

According to various embodiments, the at least one antenna module (e.g., the third antenna module 246) may include at least one communication circuit (e.g., a third RFIC (the third RFIC 226 in FIG. 2)). In the case in which at least a part of the housing is used as an antenna element (e.g., the antenna element 248), according to an embodiment, a communication circuit (e.g., the third RFIC 226) may not be disposed on the same substrate as the antenna element.

According to an embodiment, the communication module (e.g., the communication module 190 of FIG. 1) may be electrically connected to the at least one antenna module (e.g., the third antenna module 246) using at least one conductive line. The at least one conductive line may include, for example, a coaxial cable or a flexible printed circuit board (FPCB).

According to various embodiments, at least a part of the housing 310 may include a conductive material (e.g., metal (e.g., aluminum, stainless steel (STS), or magnesium)). For example, at least a part of the side member of the housing 310 may include a metal frame (or a metal bezel) structure in order to enhance the mechanical rigidity of the electronic device 300, and at least another part of the side member may include a dielectric structure (e.g., a polymer structure).

According to some embodiments, in the case in which at least a part of the housing 310 includes a metal frame structure, when a wireless signal (or a communication signal) (e.g., an RF signal) is radiated from an antenna element disposed within the electronic device, the wireless signal may be influenced by the antenna performance as it propagates along the surface of the metal frame of the housing 310.

According to various embodiments disclosed herein, the antenna structure 400 may be an antenna structure 400 provided for the 5G communication. Hereinafter, referring to FIGS. 5 to 7, even if at least a part of the housing 310 includes a conductive material, an antenna structure 400 may be described as a structure for reducing propagation path loss as much as possible and for stably transmitting/receiving millimeter waves (mmWaves).

According to an embodiment, the antenna structure 400 may be formed of a conductive material, such as, for example, a metal. The antenna structure 400 may include a conductive material so that current can be energized. For example, when the frequency is upconverted in a communication circuit (e.g., the RFIC), the antenna structure 400 may radiate an RF signal transmitted through the conductive lines to the outside. As another example, the antenna structure 400 may transmit an RF signal received via the antenna structure 400 to the communication circuit side, so that the communication circuit downconverts the RF signal to an infrared (IF) signal.

According to various embodiments, the antenna structure 400 may be formed separately from the housing 210 of the electronic device (e.g., the electronic device 300 in FIG. 3), or may be included in a part of the housing 310. For example, when the antenna structure 400 is included in a part of the housing 310, the antenna structure 400 may form the external appearance of the electronic device. According to an embodiment, the antenna structure 400 may be used to form the side member surrounding the space between the front plate and the rear plate of the housing 310.

According to an embodiment, both the antenna structure 400 and the housing 310 of the electronic device (e.g., the electronic device 300 in FIG. 3) may include a conductive material. In this case, split portions 304 are formed in the electronic device such that the electronic device may be electrically isolated from the antenna structure 400. According to another embodiment, the split portions 304 may be filled with a dielectric material (e.g., a polymeric material). According to an embodiment, a polymeric material may be formed in the split portions 304 through an injection-molding process. By providing the polymeric material to the split portions 304, it is possible to electrically disconnect the antenna structure 400 from the housing 310, to prevent foreign matter from entering from the outside of the housing 310, and to increase the durability of the electronic device by fixing the antenna structure 400 and the housing 310 to each other.

According to various embodiments, the antenna structure 400 may replace an antenna element (e.g., the antenna element 248) that is capable of being installed to a third antenna module (e.g., the third module 246 in FIG. 2). For example, when the antenna structure 400 replaces an antenna element in the case in which the antenna element is a patch antenna, a loop antenna, or a dipole antenna, a communication device may be configured in the state in which the patch antenna, the loop antenna, or the dipole antenna is omitted.

According to various embodiments, the antenna structure 400 may include a plate 401, a first extension 402, and/or a second extension 402 (not illustrated in FIG. 3), which face the outside of the electronic device (e.g., the electronic device 300 in FIG. 3). The plate 401, the first extension 402, and the third extension will be described below with reference to FIGS. 5 to 7.

Figure 5:
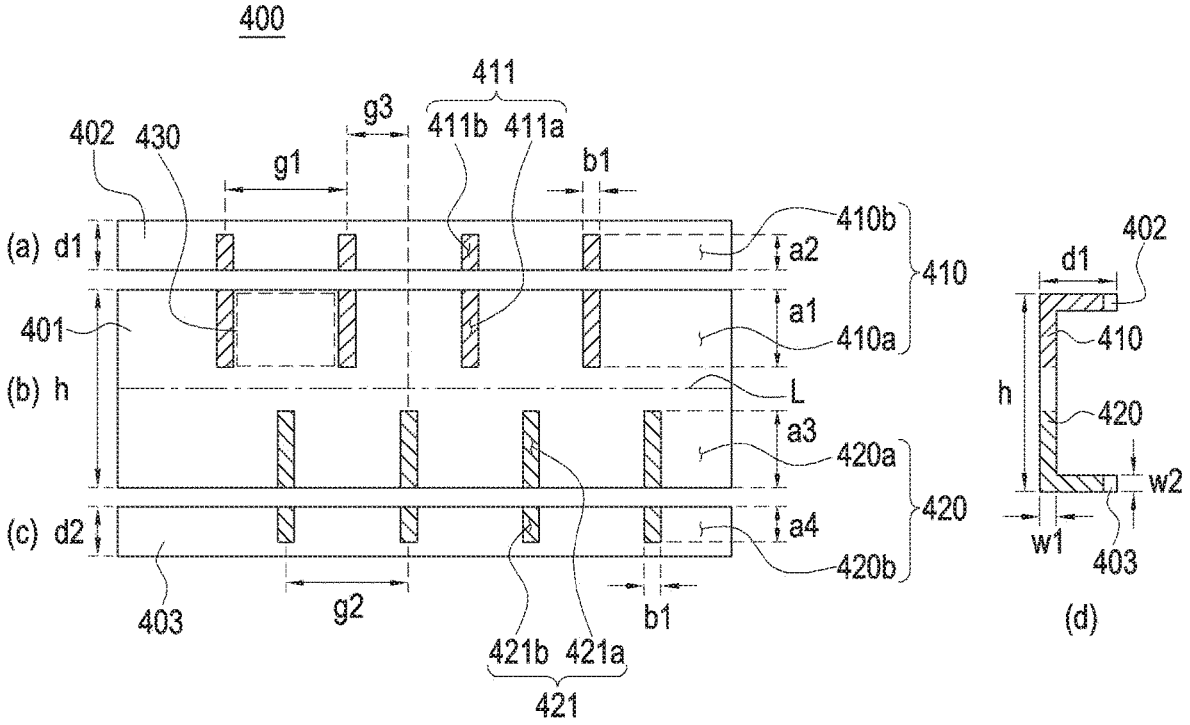
FIG. 5 is a view illustrating an antenna structure according to various embodiments of the disclosure.

FIG. 5 view (a) is a view illustrating an antenna structure 400 according to an embodiment of the disclosure, FIG. 5 view (b) is a view illustrating an antenna structure according to an embodiment of the disclosure, FIG. 5 view (c) is a view illustrating an antenna structure according to an embodiment of the disclosure, and FIG. 5 view (d) is a view illustrating an antenna structure according to an embodiment of the disclosure.

Figure 6:
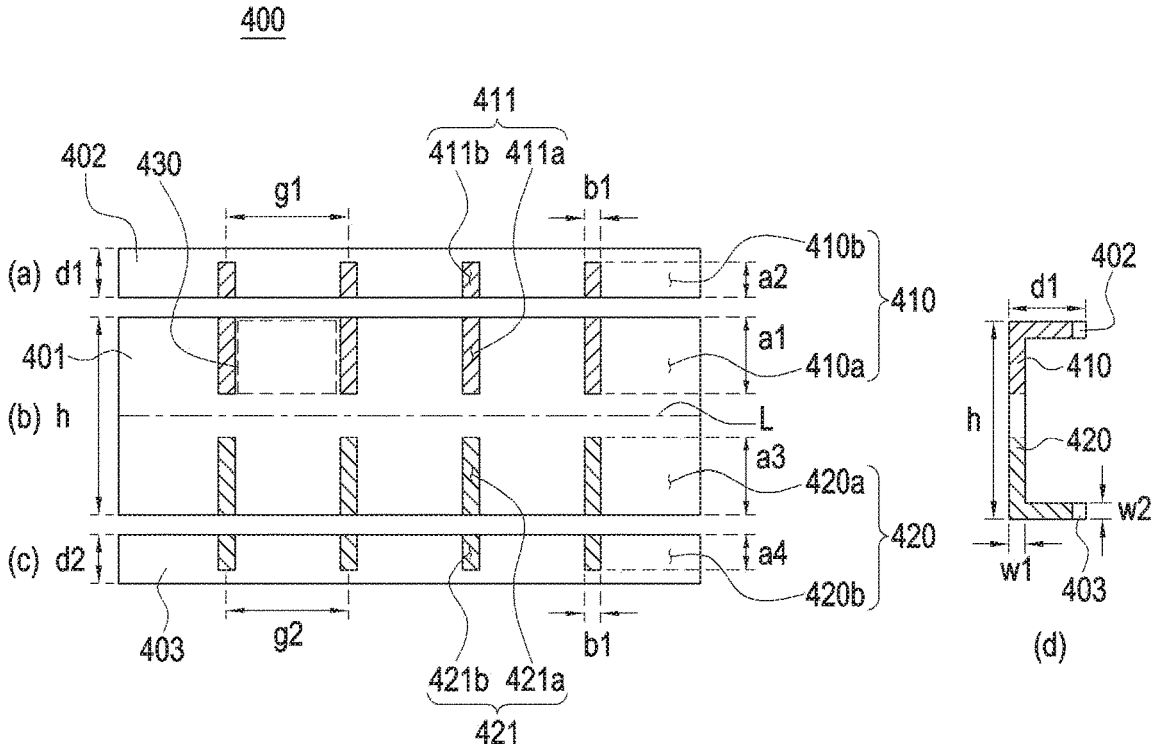
FIG. 6 is a view illustrating an antenna structure according to various embodiments of the disclosure.

FIG. 6 view (a) is a view illustrating an antenna structure 400 according to an embodiment of the disclosure, FIG. 6 view (b) is a view illustrating an antenna structure according to various embodiments of the disclosure, FIG. 6 view (c) is a view illustrating an antenna structure according to various embodiment of the disclosure, and FIG. 6 view (d) is a view illustrating an antenna structure according to various embodiment of the disclosure.

Figure 7:
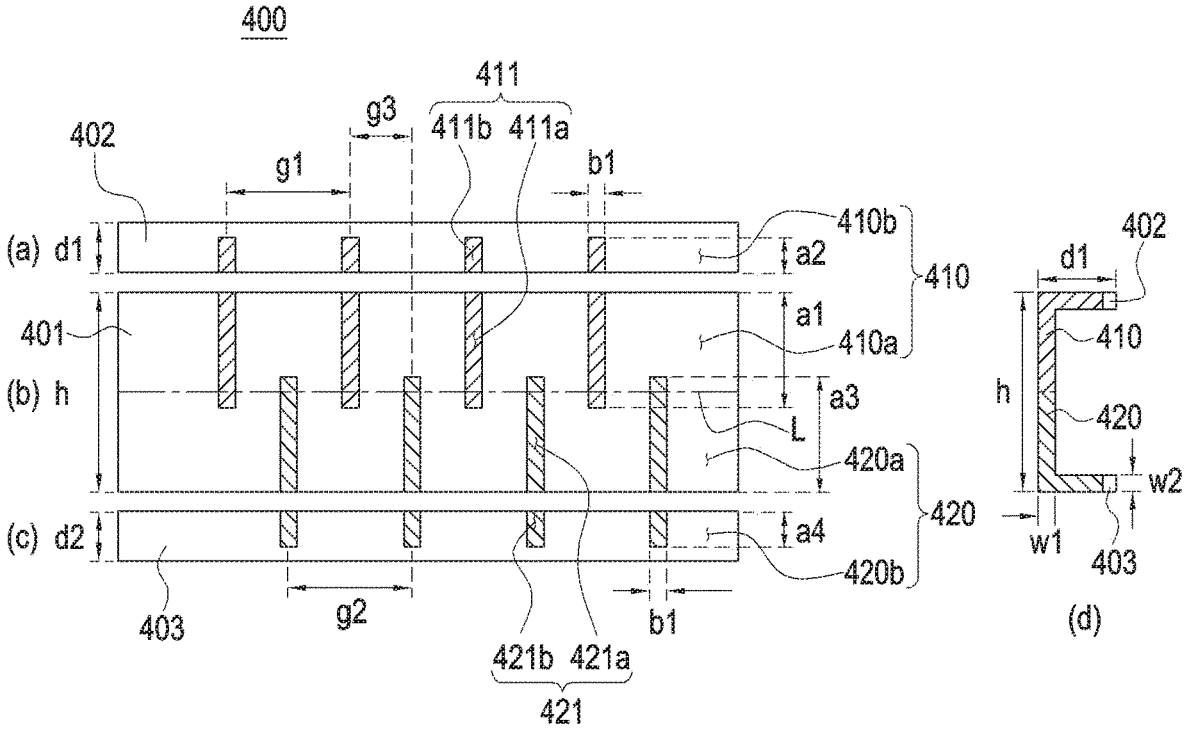
FIG. 7 is a view illustrating an antenna structure according to various embodiments of the disclosure.

FIG. 7 view (a) is a view illustrating an antenna structure 400 according to an embodiment of the disclosure, FIG. 7 view (b) is a view illustrating an antenna structure according to various embodiments of the disclosure, FIG. 7 view (c) is a view illustrating an antenna structure according to various embodiment of the disclosure, and FIG. 7 view (d) is a view illustrating an antenna structure according to various embodiment of the disclosure.

According to various embodiments, the antenna structure 400 may be in the form of a substrate, and the surface thereof may have a generally flat shape. According to an embodiment, the antenna structure 400 may include a conductive substrate having a flat surface and made of a conductive material.

According to various embodiments, an electronic device (e.g., the electronic device 300 in FIG. 3) may include a plurality of antenna structures 400. The antenna structure 400 is not limited to only a part of the electronic device, but a plurality of antenna structures 400 may be disposed in various parts of the electronic device. For example, the antenna structure 400 may be disposed not only on the lower end portion of the electronic device, as in the embodiment described above with reference to FIG. 4, but also on the upper end portion opposite thereto. Additionally or alternatively, the antenna structures may be disposed on the left side portion and/or the right side portion (see FIG. 3).

According to various embodiments, the conductive substrate may include two or more distinct areas. Here, two or more areas may be distinct from each other through some physical boundary, but may also be simply distinct through virtual lines that are not implemented in actual products. For example, the conductive substrate 401 may include a first area 410 and a second area 420 adjacent to the first area 410, which are separated by a boundary of a virtual line L, as in the embodiment illustrated in FIG. 5. Although it is illustrated that the first area 410 and the second area 420 are formed to have the same area and are symmetrical to each other with reference to the imaginary line L, the disclosure is not necessarily limited thereto. Another area (e.g., a third area (not illustrated)) may be disposed between the first area 410 and the second area 420.

According to various embodiments, the antenna structure 400 may include a plurality of slits 411 disposed in the first area 410, among two or more distinct areas of the conductive substrate 401, parallel to each other with a first predetermined interval therebetween in a predetermined direction (e.g., a direction parallel to the X-axis of FIG. 4). According to an embodiment, the plurality of slits formed parallel to each other with the first predetermined interval therebetween in the predetermined direction in the first area 410 may be referred to as first slits 411. Through the plurality of slits, a plurality of openings may be formed in one side of the electronic device (e.g., the electronic device 300 in FIG. 3). That is, a kind of antenna array (or an antenna pattern structure) may be formed through the plurality of slits. Thus, in the antenna structure 400 and the electronic device including the same according to the various embodiments disclosed herein, it is possible to finely and variously set the steering range of beams radiated from the antenna, and to cover various ranges of frequency bands required in complex multi-band communication.

According to various embodiments, the plurality of slits 411 may be, for example, four slits, as illustrated in the figure, but are not necessarily limited thereto. Two slits (e.g. slits 411*a* and 411*b*), three slits, or five or more slits may be provided. The plurality of slits 411 may extend in predetermined directions (e.g., directions parallel to the Y axis and/or the Z axis in FIG. 4), respectively. Accordingly, each of the plurality of slits 411 may be disposed parallel to a slit adjacent thereto.

With respect to the first predetermined interval therebetween, for example, in the case in which, for example, four slits are provided as illustrated in FIG. 4, the intervals between the four slits may be the same as each other. However, the disclosure is not necessarily limited thereto, and respective slits may be formed so as to have different intervals therebetween. For example, four slits may be disposed to have different intervals therebetween.

Although FIG. 5 illustrates that the widths of the plurality of slits (e.g., the first slits 411) are all the same as each other, the widths may be different from each other. Although FIG. 5 illustrates that the extension lengths of the plurality of slits (e.g., the first slits 411) are all the same as each other, the lengths may be different from each other. According to various embodiments, the plurality of slits (e.g., the first slits 411) all have the same rectangular shape, but they may have different shapes.

According to various embodiments, the antenna structure 400 may include a plurality of slits 411 disposed in the second area 420, among two or more distinct areas of the conductive substrate, parallel to each other at a second predetermined interval therebetween in a predetermined direction (e.g., a direction parallel to the X-axis of FIG. 4). According to an embodiment, the plurality of slits formed parallel to each other with the second predetermined interval therebetween in the predetermined direction in the first area 420 may be referred to as second slits 421. For example, the second slits 421 may include slits 421*a* and 421*b*. When the second slits are additionally provided in the state in which the first slits are provided, it is possible to expand the steering range of beams radiated from the antenna. For example, in the case of other hand-held type electronic devices including portable terminals, the area in which the beams are actually radiated may be greatly limited depending on how the user holds the electronic device or the portion of the electronic device that the user holds. When the antenna structure 400 and the electronic device (e.g., the electronic device 300 in FIG. 3) according to various embodiments disclosed herein are used, the steering range of the beams radiated from the antenna is expanded, and thus it is possible to minimize the deterioration of the signal strength depending on the manner in which the user holds the electronic device.

According to various embodiments, the antenna radiation using the second slits 421 may be operable independently from or together with the antenna radiation using the first slits 411.

According to various embodiments, the plurality of second slits 421 may be, for example, four slits as illustrated in the figure, but are not necessarily limited thereto. Two slits, three slits, or five or more slits may be provided. The number of the second slits 421 may not coincide with the number of the first slits 411. The plurality of second slits 421 may also extend in predetermined directions (e.g., a direction parallel to the Y axis and/or a direction parallel to the Z axis in FIG.

4), respectively, and may be disposed parallel to first slits 411 and second slits 421 adjacent thereto.

According to various embodiments, with respect to the second predetermined interval therebetween, the second slits may be disposed such that adjacent slits have the same interval from each other, or respective slits may be disposed so as not to have the same interval. The second slits may be disposed at intervals that maximize the antenna radiation performance of the antenna structure.

For example, in the case in which four slits are provided as illustrated in FIGS. 5A to 5D, the intervals between the four slits may be the same as each other. However, the disclosure is not necessarily limited thereto, and respective slits may be formed so as to have different intervals therebetween. For example, four slits may be disposed to have different intervals therebetween.

Although FIG. 5 illustrates that the widths of the plurality of slits (e.g., the second slits 421) are all the same as each other, the widths may be different from each other. Although FIG. 4 illustrates that the lengths of the plurality of slits (e.g., the second slits 421) are all the same as each other, the lengths may be different from each other.

According to various embodiments disclosed herein, at a position corresponding to an inter-slit area 430 between at least some slits of the plurality of first slits 411, the plurality of second slits 421 disposed parallel to each other at a second predetermined interval therebetween in the predetermined direction (e.g., a direction parallel to the X-axis in FIG. 4) may extend to a part of the inter-slit areas 430. According to an embodiment, the inter-slit area 430 may be an area between two adjacent slits in the plate 401. For example, the inter-slit area 430 may mean an area between two adjacent slits among the plurality of first slits 411.

Although not illustrated separately in the drawings, the inter-split area 430 may mean an area between two adjacent slits among the plurality of second slits 421, and a plurality of first slits 411 may also be disposed in the inter-slit area.

Referring to FIG. 5, according to an embodiment, the plurality of first slits 411 may be disposed alternately (or in a zigzag form) with the plurality of second slits 421.

Referring to FIG. 6, according to another embodiment, the plurality of first slits 411 may be disposed parallel to each other at positions to which the plurality of second slits 421 extend in the longitudinal direction thereof, rather than being disposed alternately with the plurality of second slits 421.

Referring to FIG. 7, according to another embodiment, the plurality of first slits 411 may be disposed alternately with the plurality of second slits 421. Here, unlike what is illustrated in FIG. 5, the plurality of second slits 421 may extend to a portion of inter-slit areas 430 between the plurality of first slits 411. That is, at least a part of the plurality of second slits 421 may be positioned between the adjacent two first slits among the plurality of first slits 411. With this method, it is possible to secure sufficiently extended length of the first slits 411 and the second slits 421. This may contribute to the formation of a thin electronic device while ensuring sufficient radiation performance in an embodiment in which the antenna structure 400 forms a side member of an electronic device (e.g., the electronic device 300 in FIG. 3).

Referring to FIGS. 4, 5, 6, and 7, the conductive substrate according to various embodiments may include a plate 401, which encloses the inner space of the electronic device (the electronic device 300 in FIG. 3) and has a first face (e.g. one of the side faces 303*a*, 303*b*, 303*c*, and 303*d* in FIG. 3) formed therein to face the outside of the electronic device. According to an embodiment, the conductive substrate may further include a first extension that extends integrally from the plate 401 and has a second face (e.g., the second face 301 in FIG. 3), at least a part of which is oriented in a direction different from the direction in which the first face is oriented. According to another embodiment, the conductive substrate may further include a second extension 403 that extends integrally from the plate 401 and has a third face (e.g., the third face 302 in FIG. 3) at least a part of which is oriented in a direction different from the direction in which the first face is oriented.

According to an embodiment, the conductive substrate may include a plate 401, a first extension 402, and a second extension 403 so as to have a ⊏-shaped cross section.

According to an embodiment, the first area 410 may be formed over the plate 401 and the first extension 402. The first area 410 may be divided into a first-first area 410*a* on the plate 401 and a first-second area 410*b* on the first extension 402. According to another embodiment, the second area 402 may be formed over the plate 401 and the second extension 402. The second area 420 may be divided into a second-first area 420*a* on the plate 401 and a second-second area 420*b* on the second extension 403. According to this, at least one of the first slits 411 may extend to at least a part of the first extension 402 through the bent portion at one side end of the plate 401. In addition, at least one of the second slits 421 may extend to at least a part of the second extension 403 through the bent portion at the other side end of the plate 401.

According to various embodiments, the electronic device 300 may further include a cover member (e.g., the rear plate) or a display member (e.g., the display member 311 in FIG. 3) that covers the first area 410 or the second area 420. The cover member may be formed of, for example, coated or colored glass, ceramics, polymer, metal, or a combination of at least two of these materials. According to this, at least one first slit formed in the first area 410 or at least one second slit formed in the second area 420 may be obscured by the cover member (e.g., the rear plate or the display member (e.g., the display member 311 in FIG. 3) without being visible to the outside.

According to an embodiment, when at least a part of metal is included as the cover member, the slits located in the first area 410 or the second area 420 should be provided in consideration of a placement relationship with the cover member and on an influence on the radiation performance. According to various embodiments, the cover member (e.g., the rear plate) or the display member (e.g., the display member 311 in FIG. 3) that covers the first area 410 or the second area 420 of the electronic device 300 may be provided with a recess into which the first extension 402 or the second extension 403 is fastened, whereby it is possible to minimize the deterioration of the radiation performance while increasing the rigidity of the electronic device (e.g., the electronic device 300 in FIG. 3).

According to various embodiments, the dimensions a1, a2, a3, a4, b1, b2, g1, g2, g3, d1, d2, h, w1, and w2 of the components illustrated in FIGS. 5 to 7 and FIG. 9, which will be described later, may be variously designed.

Figure 8:
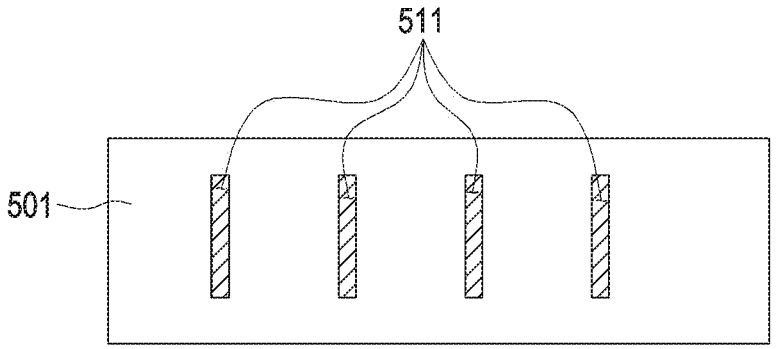
FIG. 8 is a view illustrating an antenna array according to an embodiment of the disclosure.
Figure 9:
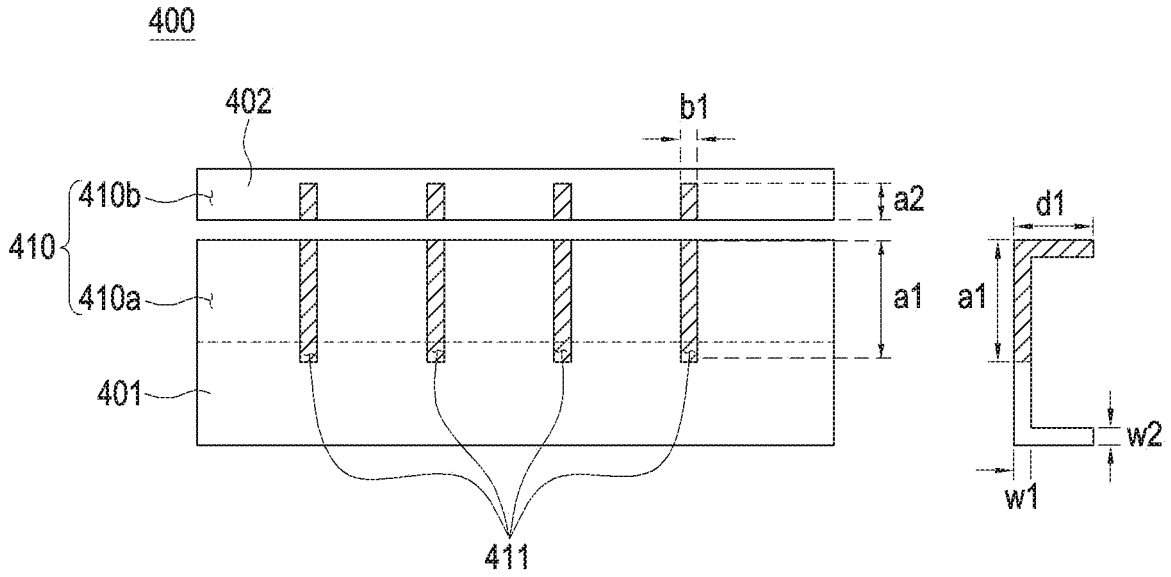
FIG. 9 is a view illustrating an antenna array according to an embodiment of the disclosure.

FIG. 8 is a view illustrating an antenna array according to various embodiments of the disclosure. FIG. 9 is a view illustrating an antenna array according to various embodiments of the disclosure.

Referring to FIG. 8, according to some embodiments, an antenna array 511 (e.g., a single slot antenna array) which is arranged on the plate 501 may linearly extend in a plane, and may radiate beams toward the outside of an electronic device (e.g., the electronic device 300 of FIG. 3). With this arrangement, an electronic device (e.g., the processor 120) may control a one-dimensional beam steering range on the horizontal plane of the electronic device, as described above with reference to FIG. 3.

Referring to FIG. 9, an antenna structure 400 according to various embodiments disclosed herein may include a plurality of first slits 411 formed in a plate 401, and among the plurality of first slits 411, at least some slits extend to at least one extension (e.g., the first extension 402), thereby facilitating the securing of the radiation range of beams on the vertical plane of the electronic device (e.g., the electronic device 300 in FIG. 3).

In summary, the antenna structure 400 may form a first antenna array through the first area 410 of the conductive substrate in which the plurality of first slits 411 are formed, and the second area 420 of the conductive substrate in which the plurality of second slits 421 are formed may form a second antenna array. Here, the first antenna array and the second antenna array may extend across two planes of the antenna structure 400 in a partially bent state. This allows the beam steering range of the antenna beams to cover substantially the entire area of the vertical plane of the electronic device 300.

Figure 10A:
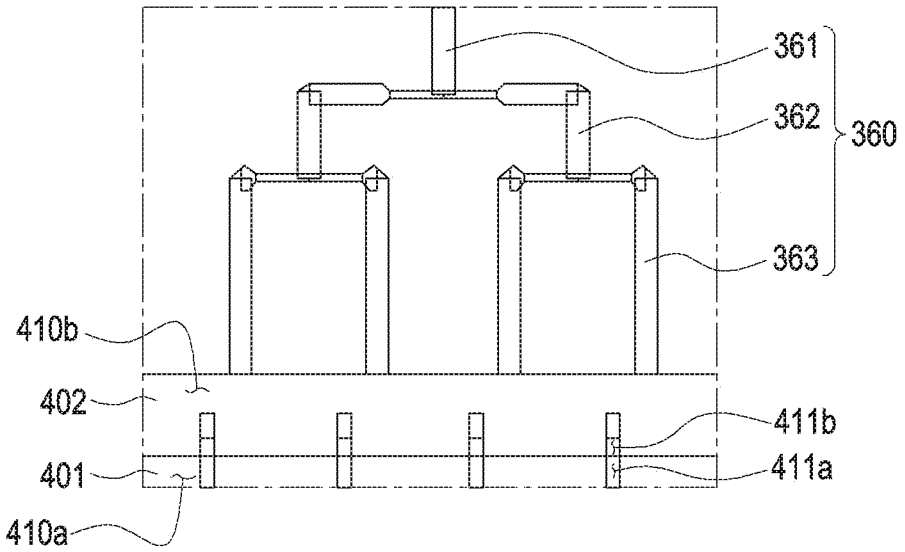
FIGS. 10A and 10B are views illustrating an aspect of an antenna structure and a feeding unit according to various embodiments of the disclosure.
Figure 10B:
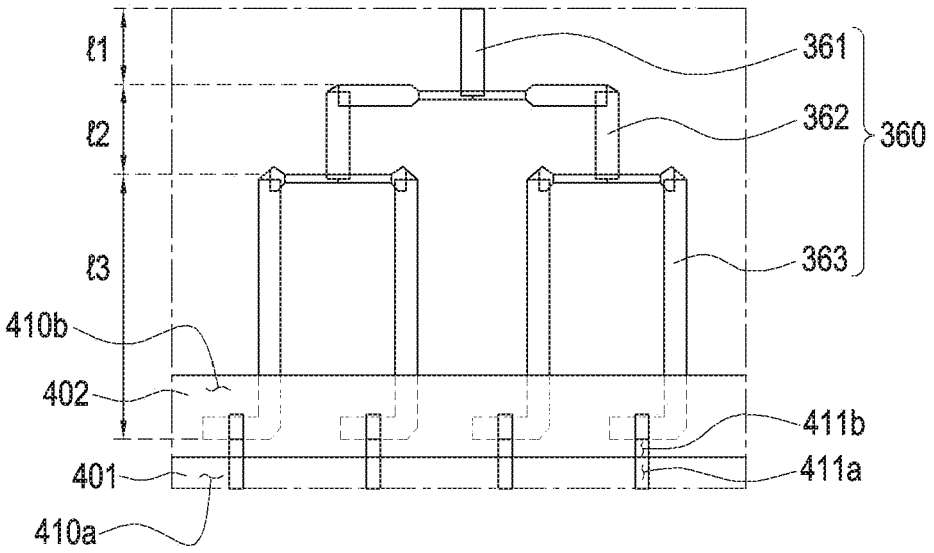

FIG. 10A is view illustrating the appearance of the antenna structure 400 and the conductive lines 360 (or a feeding part) according to various embodiments of the disclosure, and FIG. 10B is view illustrating the appearance of the antenna structure 400 and the conductive lines 360 (or a feeding part) according to various embodiments of the disclosure. It should be noted that the conductive lines 360 of FIG. 10 are merely illustrative for convenience of description. The conductive lines 360 of FIGS. 10A and 10B may be disposed to have conductive paths different from those illustrated in the drawings. Through the embodiment illustrated in FIGS. 10A and 10B, the aspect in which the conductive lines 360 are connected to the antenna structure 400 may be described with reference to the first area 410 of the antenna structure 400.

Referring to FIGS. 10A and 10B, according to an embodiment, a plurality of first conductive lines 360 may be disposed on the rear face of the conductive substrate on which a plurality of first slits 411 are disposed. According to an embodiment, the antenna structure 400 may be coupled by conductive lines 360 so as to be fed with power.

According to various embodiments, the conductive lines 360 may include one or more branched lines 361, 362, and 363. Although the lengths (11, 12, 13) of the branched lines 361, 362, and 363 in FIGS. 10 and 10B are somewhat exaggerated for convenience of description, they may have a substantially shorter length (e.g., from about 0.1λ to 1.5λ when the wavelength of resonance frequencies of millimeter waves is "λ"). The lengths 11, 12, and 13 of the conductive lines 360 may be designed to have a length that minimizes a possible propagation loss in consideration of an impedance change depending on the relative position between an RF signal and the conductive lines 360.

These embodiments may be applied to a case in which the plurality of second slits 421 is disposed in the second area 420 of the antenna structure 400.

According to various embodiments, the plurality of conductive lines included in the first conductive lines 360 may be independently capable of feeding power. According to another embodiment, each of the first conductive lines 360 may be independently capable of feeding power even when the second conductive lines (not illustrated) are operated together. For example, feeding may be performed such that communication signals flowing through at least some of the first conductive lines 360 have a first phase, and feeding may be performed such that communication signals flowing through remaining ones of the first conductive lines 360 have a second phase. Through this, a phase difference between the first conductive lines 360 may be controlled such that the antenna structure (e.g., the antenna structure 400 in FIG. 4) and the electronic device (e.g., the electronic device 300 in FIG. 3) may cover various frequency bands.

According to an embodiment, the plurality of conductive lines included in the first conductive lines 360 may cause feeding to be performed as a Single Pole Double-Throw (SPDT) switching structure. According to another embodiment, the first conductive lines 360 and the second conductive lines (not illustrated) may cause feeding to be performed as an SPDT switching structure. According to another example, the first conductive lines 360 and the second conductive lines (not illustrated) may each be configured to be directly connected to a communication circuit such as an RFIC. The direct connection with the SPDT or the RFIC may be integrated to enable hybrid beamforming. In this way, massive multi-Input multi-output (MIMO) or full-dimensional MIMO (FD-MIMO) communication may be implemented or spatial diversity may be implemented depending on the environment of a communication channel.

Figure 11:
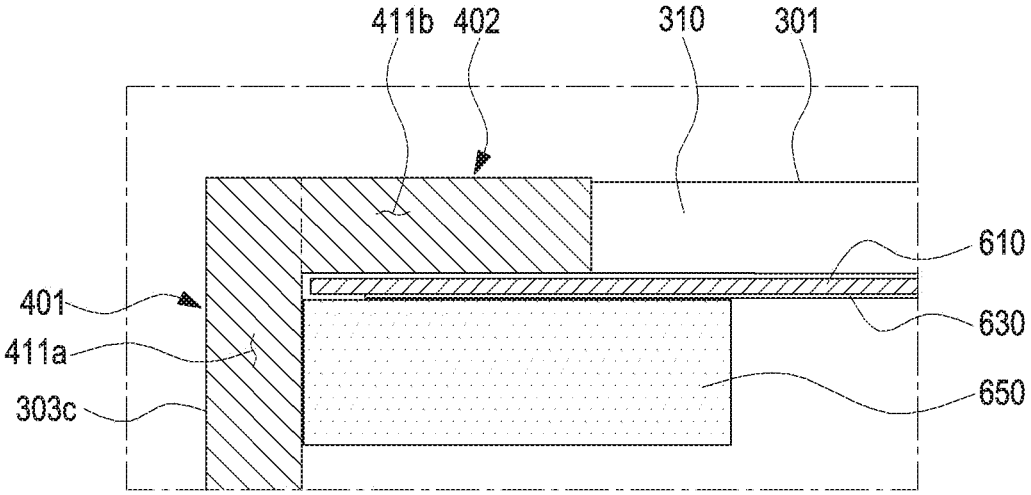
FIG. 11 is a view illustrating a connection structure between an antenna structure and a circuit board according to an embodiment of the disclosure.

FIG. 11 is a view illustrating a connection structure between an antenna structure (e.g., the antenna structure 400 in FIG. 4) and a circuit board (e.g., the first circuit board 610) according to an embodiment of the disclosure.

Figure 12:
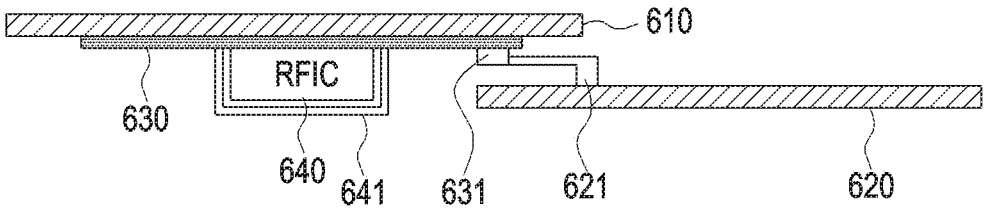
FIG. 12 is a view illustrating the configuration of a circuit board including a 5th generation (5G) module according to an embodiment of the disclosure.

FIG. 12 is a view illustrating the configuration of a circuit board including a 5G module according to an embodiment of the disclosure.

The above-mentioned conductive lines (e.g., the conductive lines 360 in FIG. 10) may include a circuit board (e.g., the first circuit board 610) and a conductive path 630 disposed in the upper or lower portion of the circuit board. A communication circuit (e.g., an RFIC) may be disposed on the circuit board, and the conductive path 630 may have a patterned wiring form, and may be formed to have a form of a microstrip line or a substrate integrated waveguide (SIW).

Referring to FIG. 11, the antenna structure (e.g., the antenna structure 400 in FIG. 4) includes the plate 401 facing the first face (e.g., the first face 303*c*) and the first extension 402 facing the second face (e.g., the second face 301) facing away from the first face (and/or the second extension (e.g., the second extension 403 in FIG. 5) facing the third face (e.g., the third face 302 in FIG. 3)), and thus the circuit board may be connected to the first extension 402 (and/or the second extension (e.g., the second extension 403 in FIG. 5)) rather than to the plate 401. Here, the term "connection" may include physical connection as well as electrical connection.

According to various embodiments, at least one of the plurality of slits may be formed across the plate 401 and the first extension 402. In addition, the slits here may be filled with a dielectric material (e.g., a polymeric material).

According to various embodiments, an electronic device (e.g., the electronic device 300 in FIG. 3) that includes an antenna structure (e.g., the antenna structure 400 in FIG. 4) may further include a fixing portion 650 within the housing 310. The fixing portion 650 may be, for example, an injection fixing portion or a normal bracket. The fixing portion 650 may be disposed adjacent to the inner face of the antenna structure (e.g., the antenna structure 400 in FIG. 4) (e.g., the inner face of the plate 401), or may be disposed below and adjacent to the circuit board (e.g., the first circuit board 610). The antenna structure (e.g., the antenna structure 400 in FIG. 4) and/or the circuit board can be stably supported at the lower portions thereof through the fixing portion 650.

Referring to FIGS. 11 and 12, the circuit board may be divided into a first circuit board 610 (e.g., the circuit board of the third antenna module 246) having at least one conductive path 630 formed thereon, and a second circuit board 620 connected to the first circuit board 610 through connection portions 621 and 631 (e.g., a coaxial cable, a connector, or an FPCB). Here, the first circuit board 610 may include a communication circuit 640 (e.g., the third RFIC 226) mounted at a position adjacent to the antenna structure (e.g., the antenna structure 400 in FIG. 4) in order to reduce propagation path loss. According to various embodiments, the first circuit board 610 may be an auxiliary circuit board having a structure (e.g., a cavity-backed model) that shields the periphery of the communication circuit 640 through a shield can 641. According to an embodiment, the communication circuit 640 may include various amplifiers and filter circuits for increasing transmission/reception signal quality or phase shift circuits for phase difference feeding. In addition, the second circuit board 620 may be a main circuit board on which a processor (e.g., the processor 120 in FIG. 1) that controls the signal flow of the communication circuit 640 is mounted.

In order to connect a circuit board provided with a communication circuit (e.g., an RFIC) to a plate 401 facing the first face 303*c* in the structure described above, it is required to bend the circuit board so as to direct the same to the first face 303*c* according to the related art. According to various embodiments disclosed herein, the plate 401 and the first extension 402 (and/or the second extension (e.g., the second extension 403 in FIG. 5)) extending from the plate 401 are formed. Thus, the first circuit board 610 including the at least one conductive path 630 and the communication circuit (e.g., the RFIC) may be connected to the first extension 402 (and/or the second extension 403 in FIG. 5). According to an embodiment, the first extension 402 of the antenna structure 400 may be coupled to the first circuit board 610 including one conductive path 630 and the communication circuit (e.g., the RFIC) so as to be fed with power. Accordingly, the circuit board 610 does not need to be bent so as to direct the same to the first surface 303*c*, thereby making it possible to manufacture an electronic device 300 with a smaller thickness.

Summarizing the embodiments illustrated in FIGS. 9 to 12, various antenna array modes may be performed using the antenna structure 400 and the conductive lines 360 according to the various embodiments disclosed herein. According to various embodiments, in the case in which a plurality of first slits 411 are formed in the first area 410 to form a first antenna array and a plurality of second slits 421 are formed in the second area 420 to form a second antenna array, it is possible to perform various antenna array modes by diversifying coupling feeding methods by the first conductive lines 360 and the second conductive lines (not illustrated).

According to an embodiment, the first conductive lines 360 may be fed with power so as to perform an antenna radiation mode (a first array mode) through the first antenna array. According to another embodiment, the second conductive lines (not illustrated) may be fed with power so as to perform an antenna radiation mode (a second array mode) through the second antenna array. According to another embodiment, the first conductive lines 360 and the second conductive lines (not illustrated) may be fed together with power so as to perform an antenna radiation mode (a third array mode) through the first antenna array and the second antenna array.

Figure 13A:
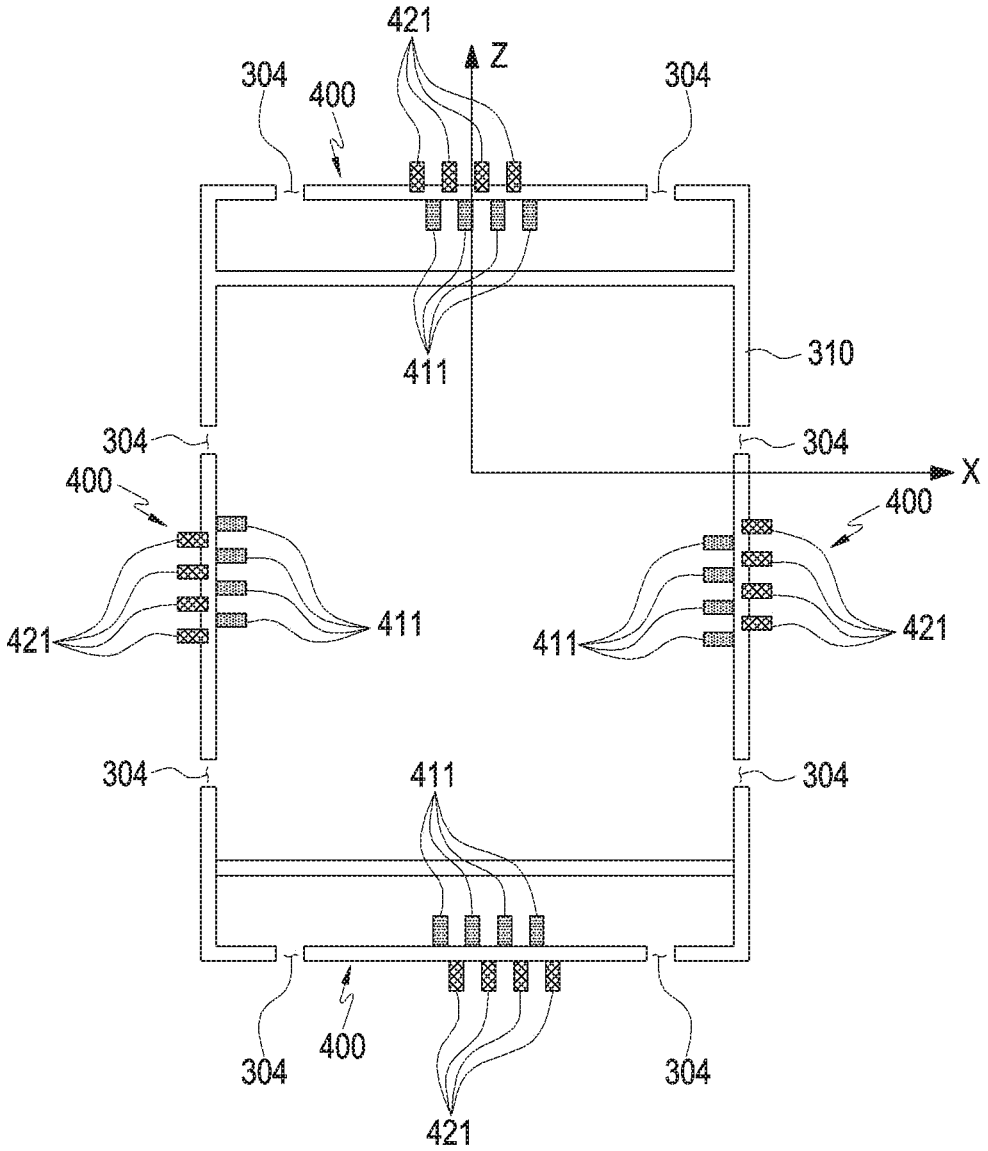
FIG. 13A is a view illustrating an electronic device including a plurality of antenna structures according to an embodiment of the disclosure.

FIG. 13A is a view illustrating an electronic device (e.g., the electronic device 300 in FIG. 3) including a plurality of antenna structures 400 according to an embodiment of the disclosure.

Figure 13B:
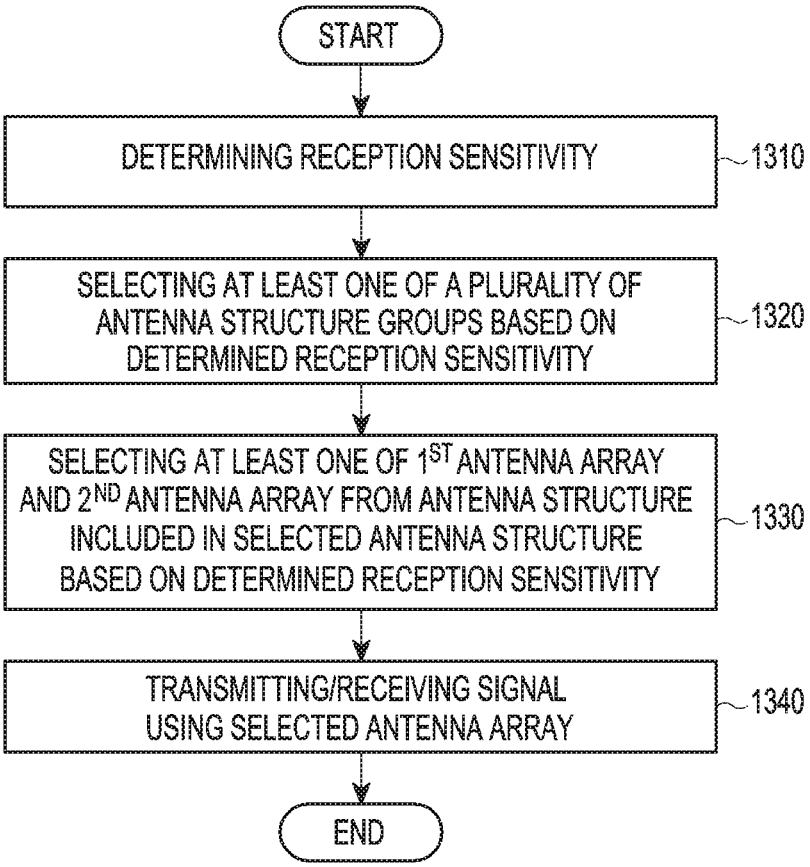
FIG. 13B is a flowchart illustrating a wireless signal transmission/reception method of an electronic device including a plurality of antenna structures according to an embodiment of the disclosure.

FIG. 13B is a flowchart illustrating a wireless signal transmission/reception method of the electronic device (e.g., the electronic device 300 in FIG. 3) including the plurality of antenna structures 400 according to an embodiment of the disclosure. For example, two pairs of antenna structures 400 are illustrated in FIG. 13A.

According to various embodiments, an electronic device (e.g., the electronic device 300 in FIG. 3) may include a plurality of antenna structures 400. The plurality of antenna structures 400 may form a plurality of antenna structure groups through various combinations, and at least one of the antenna structure groups may be selected on the basis of the reception sensitivity of a wireless signal, and may be used for wireless signal transmission/reception.

Referring to FIG. 13A, as an example of a portable terminal, the antenna structure 400 may be formed to form at least one pair. For example, the antenna structure 400 may include a first antenna structure located in at least a part of the electronic device (e.g., an antenna structure 400 positioned at the upper end of the electronic device in FIG. 13A) and a second antenna structure located at the side opposite the first antenna structure based on the center of the electronic device (e.g., the antenna structure 400 located at the lower end of the electronic device in FIG. 13A). The first antenna structure and the second antenna structure may form one antenna structure group. In addition, the antenna structure 400 may include a third antenna structure located in at least a part of the electronic device (e.g., the antenna structure 400 located at the left end of the electronic device in FIG. 13A), in place of or in addition to the first and second antenna structures described above, and a fourth antenna structure located at the side opposite the third structure (e.g., an antenna structure 400 located at the right end of the electronic device in FIG. 13A). The third antenna structure and the fourth antenna structure may form another antenna structure group.

Referring to FIG. 13B, a wireless signal transmission/reception method may be described, for example, with respect to the reception sensitivity of a wireless signal. According to various embodiments, the wireless signal transmission/reception method may include an operation of determining reception sensitivity at operation 1310. According to an embodiment, the wireless signal transmission/reception method may include an operation of selecting at least one of a plurality of groups of antenna structures on the basis of the determined receive sensitivity at operation 1320. According to an embodiment, the wireless signal transmission/reception method may include selecting at least one of a plurality of antenna arrays (e.g., a first antenna array and/or a second antenna array) from an antenna structure (e.g., the antenna structure 400 located at the lower end of the housing 310 in FIG. 13A) included in the antenna structure group selected on the basis of the determined reception sensitivity at operation 1330. In addition, the wireless signal transmission/reception method may include an operation of transmitting/receiving a wireless signal using the at least one selected antenna array (e.g., the first antenna array and/or the second antenna array) at operation 1340.

By forming the antenna structure 400 as described above, it is possible to implement various antenna radiation modes such as diversity, massive MIMO, and FD-MIMO. For example, in order to implement the MIMO, a plurality of communication devices (a first communication device, a second communication device, a third communication device, and a fourth communication device) within an electronic device (e.g., the electronic device 300 of FIG. 3) may be set to transmit and receive radio waves having different frequencies.

Figure 14:
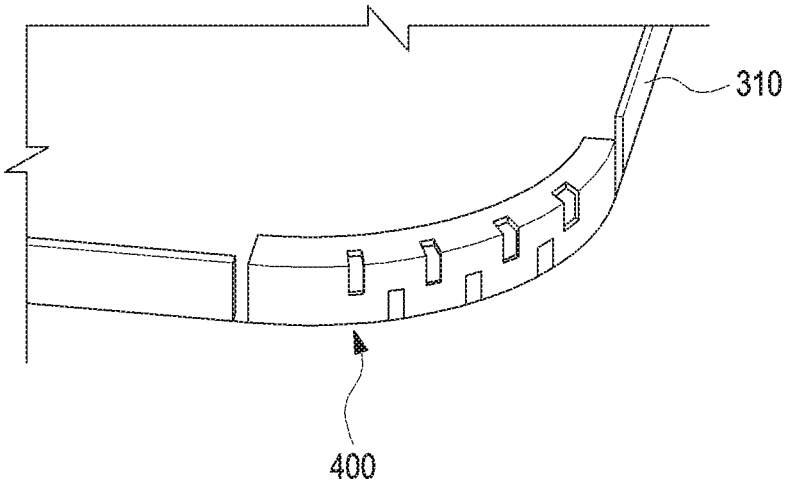
FIG. 14 is a view illustrating a location where an antenna structure is disposed according to an embodiment of the disclosure.

FIG. 14 is a view illustrating a location where an antenna structure 400 according to various embodiments is disposed according to an embodiment of the disclosure.

Referring to FIG. 14, according to various embodiments, the antenna structure 400 may also be disposed on a curved portion of an electronic device (e.g., the electronic device 300 of FIG. 3). Antenna structures 400 formed in a flat portion of the electronic device (e.g., the electronic device 300 in FIG. 3) are illustrated in the foregoing drawings, but are not necessarily limited thereto.

Referring to FIG. 14, the antenna structure 400 may be located in the curved portion of an edge area of the electronic device (e.g., the electronic device 300 in FIG. 3), as in the example represented in FIG. 14, and may be used in addition to or in place of the antenna structure 400 disposed in the flat portion as described above.

An antenna structure 400 according to various embodiments disclosed herein may be used in the state of being disposed on one side of the housing 310 of an electronic device (e.g., the electronic device 300 in FIG. 3), as illustrated in FIG. 4 or 14. In addition, a plurality of antenna structures 400 may be provided, and may be disposed on one side of the housing 310 of the electronic device (e.g., 300 of FIG. 3) as well as on the other side. In addition, an antenna structure 400 according to various embodiments disclosed herein may include a plurality of slits (e.g., the slits 411 and the slits 421 in FIG. 5) in a first area (e.g., the first area 410 in FIG. 5) and/or a second area (e.g., the second area 420 in FIG. 5). In addition, a plurality of slits (e.g., the slits 411 and/or the slits 421 in FIG. 5) according to various embodiments disclosed herein may be used in combination with the slot antenna array illustrated in FIG. 8 (e.g., a single slot antenna array).

Figure 15:
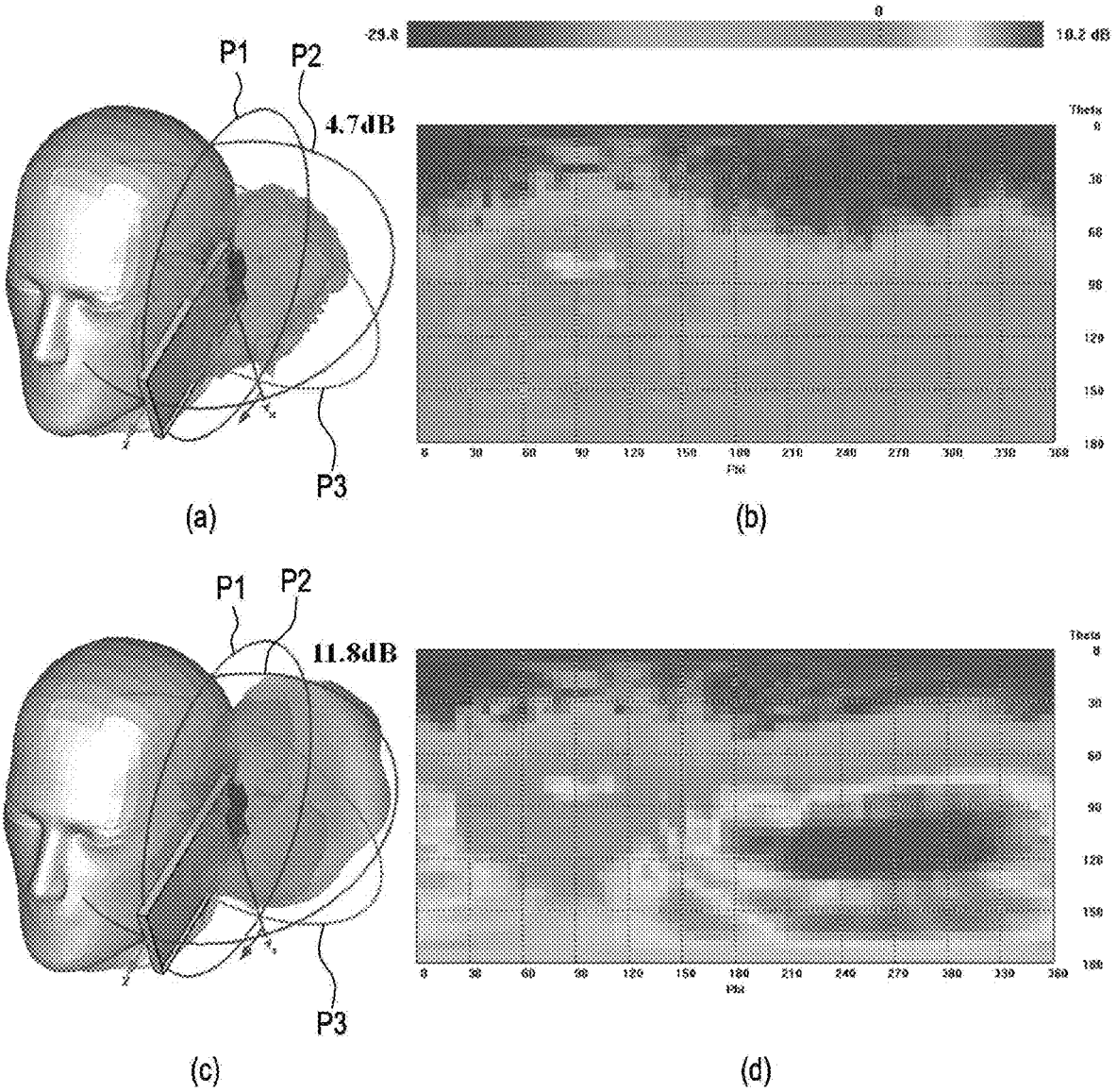
FIG. 15 is a view illustrating the radiation range of an antenna structure in a hand-held electronic device according to various embodiments of the disclosure.

FIG. 15 view (a) is a diagram illustrating the radiation range of an antenna structure (e.g., the radiation structure 400 in FIG. 4) in a hand-held-type electronic device according to various embodiment of the disclosure (e.g., the electronic device 300 in FIG. 3). FIG. 15 view (b) is a diagram illustrating the radiation range of an antenna structure (e.g., the radiation structure 400 in FIG. 4) in a hand-held-type electronic device according to various embodiment of the disclosure (e.g., the electronic device 300 in FIG. 3). FIG. 15 view (c) is a diagram illustrating the radiation range of an antenna structure (e.g., the radiation structure 400 in FIG. 4) in a hand-held-type electronic device according to various embodiment of the disclosure (e.g., the electronic device 300 in FIG. 3). FIG. 15 view (d) is a diagram illustrating the radiation range of an antenna structure (e.g., the radiation structure 400 in FIG. 4) in a hand-held-type electronic device according to various embodiment of the disclosure (e.g., the electronic device 300 in FIG. 3).

Figure 16:
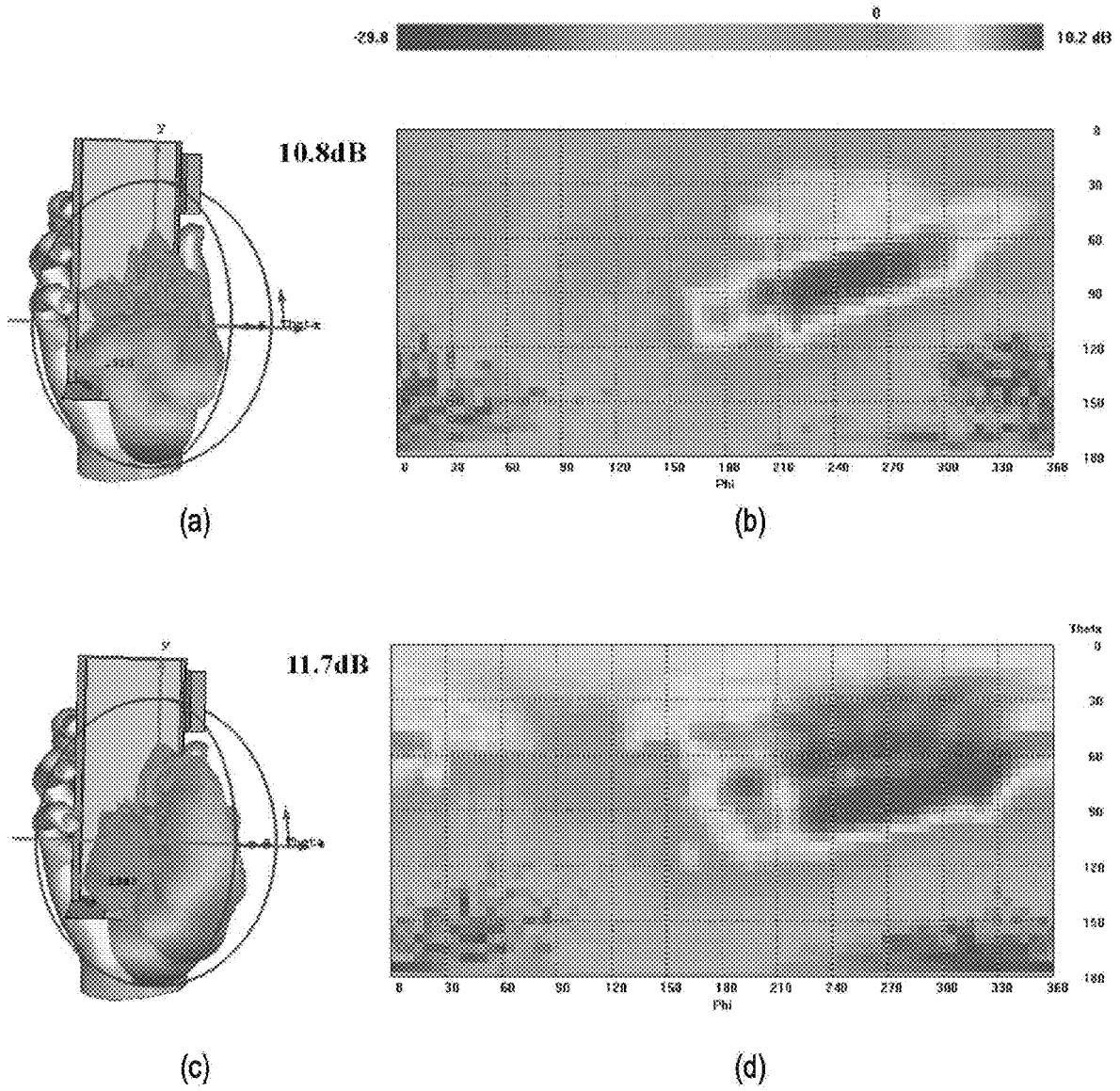
FIG. 16 is a view illustrating the radiation range of an antenna structure in a hand-held electronic device according to various embodiments of the disclosure.

FIG. 16 view (a) is a diagram illustrating the radiation range of an antenna structure (e.g., the radiation structure 400 in FIG. 4) in a hand-held-type electronic device according to various embodiment of the disclosure (e.g., the electronic device 300 in FIG. 3). FIG. 16 view (b) is a diagram illustrating the radiation range of an antenna structure (e.g., the radiation structure 400 in FIG. 4) in a hand-held-type electronic device according to various embodiment of the disclosure (e.g., the electronic device 300 in FIG. 3). FIG. 16 view (c) is a diagram illustrating the radiation range of an antenna structure (e.g., the radiation structure 400 in FIG. 4) in a hand-held-type electronic device according to various embodiment of the disclosure (e.g., the electronic device 300 in FIG. 3). FIG. 16 view (d) is a diagram illustrating the radiation range of an antenna structure (e.g., the radiation structure 400 in FIG. 4) in a hand-held-type electronic device according to various embodiment of the disclosure (e.g., the electronic device 300 in FIG. 3).

Referring to FIG. 15 views (a) to (d) represent the radiation range of antenna beams when an electronic device (e.g., the electronic device 300 in FIG. 3) is used at a position adjacent to the user's head. FIG. 15 view (a) and (b) show simulation results for an antenna structure having a one-dimensional beam radiation range in an electronic device. FIG. 15 views (c) and (d) show simulation results for an antenna structure device having a two-dimensional beam radiation range in an electronic device according to various embodiments disclosed herein.

Referring to FIG. 16 views (a) to (d) are diagrams representing the radiation range of an antenna beam when the user is holding an electronic device (e.g., the electronic device 300 in FIG. 3). FIG. 16 views (a) and (b) show simulation results for an antenna structure having a one-dimensional beam radiation range. FIG. 16 views (c) and (d) show simulation results for an electronic device (e.g., the electronic device 300 in FIG. 3) including an antenna structure device (e.g., the antenna structure 400 in FIG. 4) having a two-dimensional beam radiation range in an electronic device according to various embodiments disclosed herein.

Summarizing FIG. 15, it can be seen that the radiation range of antenna beams by an antenna structure according to the various embodiments disclosed herein covers a wide bandwidth compared to an antenna structure having a one-dimensional beam radiation range. That is, it can be deduced from the simulation results described above that, when the antenna structure and the electronic device including the antenna structure according to various embodiments disclosed herein are used, it is possible to secure stable communication performance by reducing the influence of interference due to a peripheral structure of the antenna structure or the user's body part.

Figure 17:
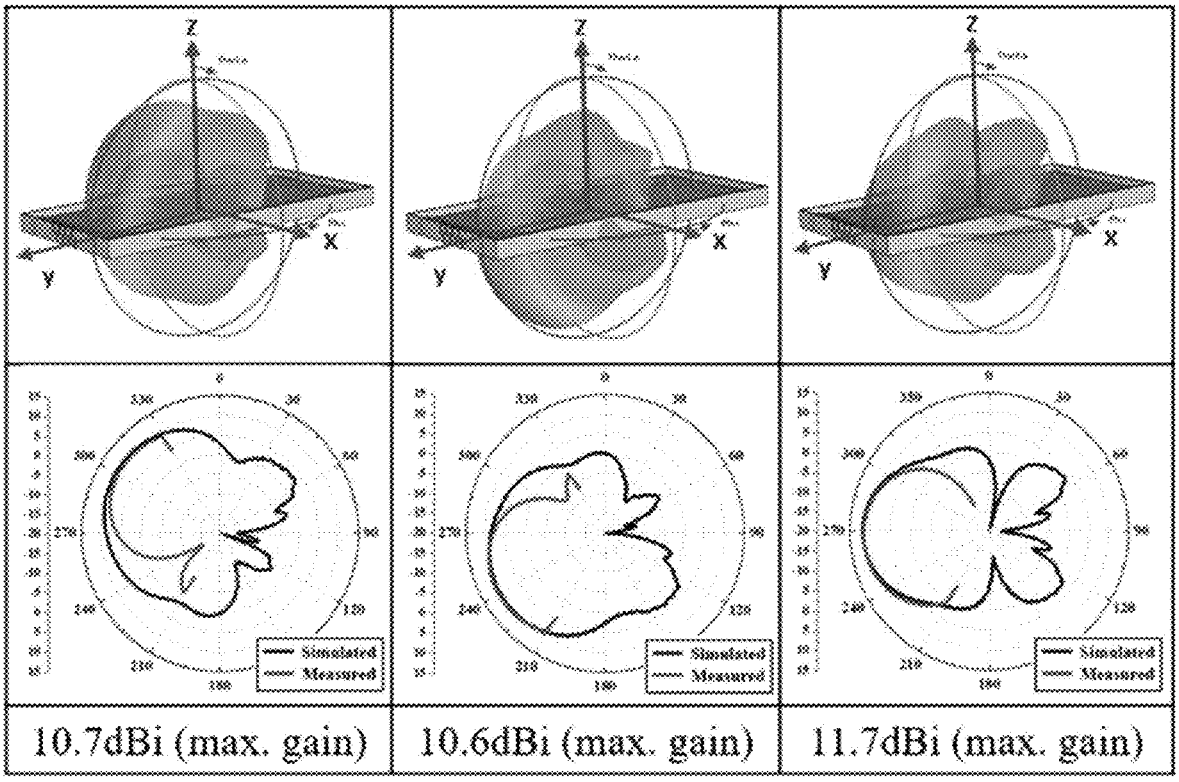
FIG. 17 is a view illustrating the radiation range of an antenna structure according to various embodiments of the disclosure.

FIG. 17 view (a) is a view illustrating the radiation range of an antenna structure according to various embodiments of the disclosure, FIG. 17 view (b) is a view illustrating the radiation range of an antenna structure according to various embodiments of the disclosure, and FIG. 17 view (c) is a view illustrating the radiation range of an antenna structure according to various embodiments of the disclosure.

Referring to FIG. 17 views (a) to (c) represent gain characteristics according to various antenna beam radiation modes when an electronic device (e.g., the electronic device 300 in FIG. 3) includes an antenna structure 400 having a plurality of slits (e.g., the slits 411 and 421 in FIG. 4) according to an embodiment of the disclosure. Through the gain characteristics, the radiation patterns according to various antenna beam radiation modes of the antenna structure 400 may be confirmed.

FIG. 17 view (a) represents a radiation pattern according to a first antenna array mode, in which a first antenna array provided with a plurality of first slits (e.g., the first slits 411 in FIG. 4) is fed with power. FIG. 17 view (b) represents a radiation pattern according to a second antenna array mode, in which a second antenna array provided with a plurality of second slits (e.g., the second slits 421 in FIG. 4) is fed with power. FIG. 17 view (c) represents a radiation pattern according to a third antenna array mode, in which a first antenna array and a second antenna array are both fed with power.

Figure 18:
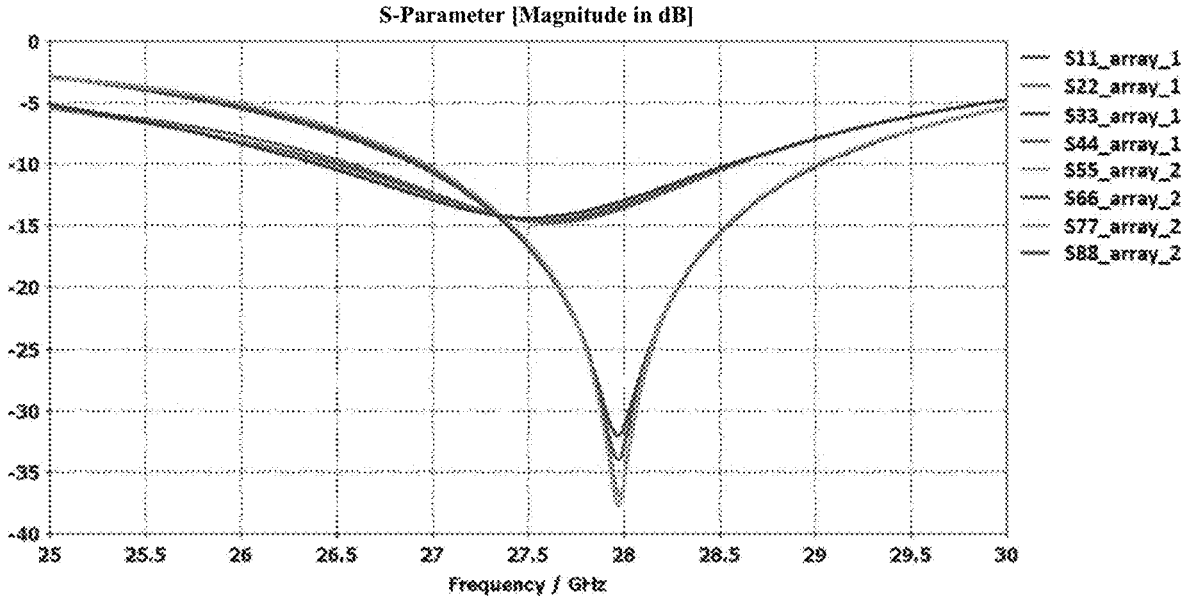
FIG. 18 is a view illustrating reflection coefficients of an antenna structure having a plurality of slits according to an embodiment of the disclosure.

FIG. 18 is a view illustrating reflection coefficients of an antenna structure (e.g., the antenna structure 400 in FIG. 4) having therein a plurality of slits according to an embodiment of the disclosure.

Referring to FIG. 18, from S11, S22, S33, and S44, it is possible to identify the resonant frequency of each slit of the first antenna array included in an antenna structure (e.g., the antenna structure 400 in FIG. 4), and from S55, S66, S77 and S88, it is possible to identify the resonant frequency of each element (e.g., a slit) of the second antenna array included in an antenna structure (e.g., the antenna structure 400 in FIG. 4) disclosed herein. It can be seen that the first antenna array and the second antenna array are able to form a resonant frequency between approximately 27.5 GHz and 28 GHz.

As can be seen from the drawing, the first antenna array and the second antenna array are able to cover various resonant frequency ranges. Thus, it is possible to cover various ranges of frequency bands required in complex multi-band communication.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to various embodiments disclosed herein, an electronic device (e.g., the electronic device 300 in FIG. 3) may include: a communication module (e.g., the communication module 190 in FIG. 1); and an antenna structure (e.g., the antenna structure 400 in FIG. 4) electrically connected to the communication module. The antenna structure may include: a conductive substrate including a first area (the first area 410 in FIG. 5) and a second area (e.g., the second area 420 in FIG. 5) adjacent to the first area; a plurality of first slits (e.g., the first slits 411 in FIG. 5) disposed in the first area of the conductive substrate parallel to each other with a first predetermined interval therebetween in a predetermined direction; and a plurality of second slits formed in the second area of the conductive substrate at a position corresponding to an inter-slit area between at least some slits among the plurality of first slits. The plurality of second slits (e.g., the second slits 421 in FIG. 5) are parallel to each other at a second predetermined interval therebetween in the predetermined direction, and the plurality of second slits extend to a portion of the inter-slit area.

According to various embodiments, the conductive substrate may include a plate (e.g., the plate 401 in FIG. 5) that surrounds an inner space of the electronic device and has a first face (e.g., the first face 303*c* in FIG. 3) facing an outside of the electronic device.

According to various embodiments, the electronic device may further include a first extension (e.g., the first extension 402 in FIG. 5) integrally extending from the plate and having a second face (e.g., the second face 301 in FIG. 3), at least a portion of which is oriented in a direction different from a direction in which the first face is oriented.

According to various embodiments, the first area may be disposed over a part of the plate and the first extension.

According to various embodiments, the electronic device may further include a second extension (e.g., the second extension 403 in FIG. 5) integrally extending from the plate and having a third face (e.g., the third face 302 in FIG. 3), at least a portion of which is oriented in a direction different from the direction the direction in which the first face is oriented and the direction in which the second face is oriented.

According to various embodiments, the second area may be disposed over a part of the plate and the second extension.

According to various embodiments, the electronic device may further include a cover member or a display member that covers the first area or the second area.

According to various embodiments, the plurality of first slits (e.g., the first slits 411 in FIG. 4A) may form a first antenna array, and a plurality of second slits (e.g., the second slits 421 in FIG. 4) may form a second antenna array.

According to various embodiments, a plurality of first conductive lines (e.g., the first conductive lines 360 in FIGS. 10A and 10B) may be disposed adjacent to each other on the rear face of the conductive substrate in which the plurality of first slits are formed, and a plurality of second conductive lines (not illustrated) may be disposed adjacent to each other on the rear face of the conductive substrate in which the plurality of second slits are formed.

According to various embodiments, each of the first conductive lines (e.g., the conductive lines 360 in FIGS. 10A and 10B) and the second conductive lines (not illustrated) may be capable of being independently fed with power.

According to various embodiments, the electronic device may further include: a plate that surrounds an inner space of the electronic device, the plate having a first face facing an outside of the electronic device; a first extension integrally extending from the plate and having a second face, at least a portion of which is oriented in a direction different from a direction in which the first face is oriented, or a second extension integrally extending from the plate and having a third face, at least a portion of which is oriented in a direction different from a direction in which the first face is oriented. Each of the first conductive lines or the second conductive lines may be connected to the first extension or the second extension.

According to various embodiments, the electronic device may further include at least one processor (e.g., the processor in FIG. 1), and the processor may be configured to: control beamforming in a horizontal direction using the antenna structure, or control beamforming in a vertical direction using the antenna structure.

According to various embodiments, the electronic device may further include: a plurality of antenna structure groups each including at least one antenna structure; and at least one processor. The processor may be configured to: select at least one antenna structure group from among the plurality of antenna structure groups depending on the sensitivity of a signal transmitted to or received from the electronic device, and select at least one antenna array included in the antenna structure of at least one antenna structure included in the selected antenna structure group.

According to various embodiments, the electronic device may further include at least one processor and the processor may configured to control beamforming depending on a predetermined antenna radiation mode.

According to various embodiments, in the electronic device, at least one pair of antenna structures are formed, and the antenna structures forming the at least one pair may include a first antenna structure located in at least a part of the electronic device and a second antenna structure positioned opposite the first antenna structure with reference to the center of the electronic device.

According to various embodiments, the antenna structure may be located in at least a part of a curved face of the electronic device.

According to various embodiments disclosed herein, an electronic device (e.g., the electronic device 300 in FIG. 3) may include: a communication module (e.g., the communication module 190 in FIG. 1) and an antenna structure (e.g., the antenna structure 400 in FIG. 4) electrically connected to the communication module. The antenna structure may include: a conductive substrate including a first area (the first area 410 in FIG. 5) and a second area (e.g., the second area 420 in FIG. 5) adjacent to the first area; a plurality of slits (e.g., the slits 411 in FIG. 4) disposed in the first area of the conductive substrate parallel to each other with a first predetermined interval therebetween in a predetermined direction; and one or more slits (e.g., the slits 421 in FIG. 4) disposed in the second area of the conductive substrate at a position corresponding to an inter-slit area between at least some slits among the plurality of slits. The one or more slits are formed parallel to the at least some slits and the one or more slits extend to a portion of the inter-slit area.

According to various embodiments, the electronic device may further include a cover member or a display member that covers at least a part of the first area.

According to various embodiments, a plurality of first conductive lines (e.g., the first conductive lines 360 in FIG. 10A) may be disposed adjacent to each other on a rear face of the conductive substrate in which the plurality of first slits are formed, and a plurality of second conductive lines may be formed adjacent to each other on the rear face of the conductive substrate in which the plurality of second slits are formed.

According to various embodiments, an electronic device (e.g., the electronic device 300 in FIG. 3) may include: a housing (e.g., the housing 310 in FIG. 3) having a space formed therein to accommodate at least one electronic component therein; and at least one antenna structure (e.g., the antenna structure 400 in FIG. 400) disposed in at least a part of the housing, the at least one antenna structure including a plate (e.g., the plate 401 in FIG. 5) that surrounds an inner space of the electronic device, the plate having a first face (e.g., the first face 303*c* in FIG. 3) facing the outside of the electronic device, and at least one of a first extension (e.g., the first extension 402 in FIG. 4) integrally extending from the plate and having a second face (e.g., the second face 301 in FIG. 3), at least a portion of which is oriented in a direction different from a direction in which the first face is oriented, or a second extension (e.g., the second extension 403 in FIG. 4) integrally extending from the plate and having a third face (e.g., the third face 302 in FIG. 3), at least a portion of which is oriented in a direction different from a direction in which the first face is oriented. The antenna structure may include a plurality of slits (e.g., the slits 411 and/or the slits 421 in FIG. 4) disposed in at least a part of the plate and at least a part of the first extension or in at least a part of the plate and at least a part of the second extension parallel to each other with a predetermined interval therebetween.

According to various embodiments, the housing and the antenna structure may include a conductive material, and the antenna structure may be electrically isolated from the housing by a split portion (e.g., the split portion 304 in FIG. 4).

In the detailed description of various embodiments disclosed herein, specific embodiments of the disclosure have been described. However, it will be evident to a person ordinarily skilled in the art that various modification may be made without departing from the gist of the disclosure. For example, in a specific embodiment of the disclosure, an arrangement structure such as a plurality of first slits or a plurality of second slits, and a frequency band according to the operation of the arrangement structure or a frequency band in which the resonant frequency is formed are exemplified. However, these may be appropriately set depending on the configuration, required specifications, the actual use environment, and the like of an antenna structure to be actually manufactured or an electronic device to be equipped with the antenna structure.

While the disclosure has been shown described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:
a communication module; and
an antenna structure electrically connected to the communication module,
wherein the antenna structure includes:
a conductive substrate including a first area and a second area adjacent to the first area,
a plurality of first slits formed in the first area of the conductive substrate parallel to each other with a first predetermined interval therebetween in a predetermined direction, and
a plurality of second slits formed in the second area of the conductive substrate at a position corresponding to an inter-slit area between at least some slits among the plurality of first slits, the plurality of second slits being parallel to each other at a second predetermined interval therebetween in the predetermined direction, and
wherein the plurality of second slits are configured to extend to a portion of the inter-slit area.

2. The electronic device of claim 1, wherein the conductive substrate includes a plate that surrounds an inner space of the electronic device, the plate including a first face facing an outside of the electronic device.

3. The electronic device of claim 2, further comprising:
a first extension extending from the plate and including a second face, at least a portion of which is oriented in a direction different from a direction in which the first face is oriented.

4. The electronic device of claim 3, wherein the first area is disposed over a part of the plate and the first extension.

5. The electronic device of claim 3, further comprising:
a second extension integrally extending from the plate and including a third face, at least a portion of which is oriented in a direction different from a direction in which the first face is oriented and a direction in which the second face is oriented.

6. The electronic device of claim 5, wherein the second area is disposed over a part of the plate and the second extension.

7. The electronic device of claim 3, further comprising:
a cover member or a display member that covers at least a part of the first extension.

8. The electronic device of claim 1,
wherein the plurality of first slits form a first antenna array, and
wherein the plurality of second slits form a second antenna array.

9. The electronic device of claim 1,
wherein a plurality of first conductive lines are disposed adjacent to each other on a rear face of the conductive substrate in which the plurality of first slits are formed, and
wherein a plurality of second conductive lines are disposed adjacent to each other on the rear face of the conductive substrate in which the plurality of second slits are formed.

10. The electronic device of claim 9, wherein each of the first conductive lines and the second conductive lines is capable of being independently fed with power.

11. The electronic device of claim 9, further comprising:
a plate that surrounds an inner space of the electronic device, the plate including a first face facing an outside of the electronic device; and
a first extension integrally extending from the plate and including a second face, at least a portion of which is oriented in a direction different from a direction in which the first face is oriented, or a second extension integrally extending from the plate and including a third face, at least a portion of which is oriented in a direction different from the direction in which the first face is oriented,
wherein each of the first conductive lines or the second conductive lines is connected to the first extension or the second extension.

12. The electronic device of claim 1, further comprising:
at least one processor,
wherein the at least one processor is configured to:
control beamforming in a horizontal direction using the antenna structure, or
control beamforming in a vertical direction using the antenna structure.

13. The electronic device of claim 1, further comprising:
a plurality of antenna structure groups each including at least one antenna structure; and
at least one processor,
wherein the at least one processor is configured to:
select at least one antenna structure group among the plurality of antenna structure groups depending on sensitivity of a signal transmitted to or received from the electronic device, and select at least one antenna array included in an antenna structure of at least one antenna structure included in the selected at least one antenna structure group.

14. The electronic device of claim 13, wherein the at least one processor is further configured to control beamforming based on a predetermined antenna radiation mode.

15. The electronic device of claim 1, wherein the antenna structure is located in at least a part of a curved face of the electronic device.

16. The electronic device of claim 1, wherein at least a distal end portion of at least one of the plurality of second slits extend between at least a distal end portion of at least two of the plurality of first slits.

17. An electronic device comprising:

a communication module; and an antenna structure electrically connected to the communication module, wherein the antenna structure includes:

a conductive substrate including a first area and a second area adjacent to the first area, a plurality of slits formed in the first area of the conductive substrate parallel to each other with a first predetermined interval therebetween in a predetermined direction, and a one or more slits formed in the second area of the conductive substrate at a position corresponding to an inter-slit area between at least some slits among the plurality of slits, the one or more slits being disposed parallel to the at least some slits at a second predetermined interval therebetween in the predetermined direction, and wherein the one or more slits are configured to extend to a portion of the inter-slit area.

18. The electronic device of claim 17, further comprising:

a cover member or a display member that covers at least a part of the first area.

19. The electronic device of claim 17, wherein a plurality of first conductive lines are disposed adjacent to each other on a rear face of the conductive substrate in which the plurality of slits are formed, and wherein a plurality of second conductive lines are disposed adjacent to each other on the rear face of the conductive substrate in which the one or more slits are formed.

20. An electronic device comprising:

a housing including a space formed therein to accommodate at least one electronic component therein; and at least one antenna structure disposed in at least a part of the housing, wherein the at least one antenna structure includes:

a plate that surrounds an inner space of the electronic device, the plate including a first face facing an outside of the electronic device, at least one of a first extension integrally extending from the plate and including a second face, at least a portion of which is oriented in a direction different from a direction in which the first face is oriented, or a second extension integrally extending from the plate and including a third face, at least a portion of which is oriented in a direction different from the direction in which the first face is oriented, and a plurality of slits formed in at least a part of the plate and at least a part of the first extension or in at least a part of the plate and at least a part of the second extension parallel to each other with a predetermined interval therebetween, and wherein the plurality of slits formed in the at least the part of the plate and the at least the part of the first extension or the at least the part of the second extension are parallel to each other on separate planes.

21. The electronic device of claim 20, wherein the housing and the at least one antenna structure include a conductive material, and wherein the at least one antenna structure is electrically isolated from the housing by a split portion.

* * * * *